US011859902B2

(12) United States Patent
Pell et al.

(10) Patent No.: US 11,859,902 B2
(45) Date of Patent: Jan. 2, 2024

(54) SUPERCOOLING AGITATING BEVERAGE CONTAINER

(71) Applicant: ChillyBev, LLC, Austin, TX (US)

(72) Inventors: William Pell, Austin, TX (US); Jerry Haile, Austin, TX (US); Michael Rockafellow, Austin, TX (US); Jody Wingrove, Austin, TX (US)

(73) Assignee: CHILLYBEV, LLC, Austin, TX (US)

( * ) Notice: Subject to any disclaimer, the term of this patent is extended or adjusted under 35 U.S.C. 154(b) by 168 days.

(21) Appl. No.: 16/675,552

(22) Filed: Nov. 6, 2019

(65) Prior Publication Data

US 2020/0149804 A1 May 14, 2020

Related U.S. Application Data

(60) Provisional application No. 62/757,334, filed on Nov. 8, 2018.

(51) Int. Cl.
*F25D 31/00* (2006.01)

(52) U.S. Cl.
CPC ..... *F25D 31/003* (2013.01); *F25D 2317/00* (2013.01); *F25D 2325/00* (2013.01)

(58) Field of Classification Search
CPC ..... F25D 31/003; F25D 2325/00; F25D 2303/0841; F25D 2400/28; F25D 31/007; F25D 25/00; B65D 81/18; H02P 25/032; H02P 8/00
See application file for complete search history.

(56) References Cited

U.S. PATENT DOCUMENTS 507,996 A * 11/1893 Cobin et al. ..... F25D 3/08 366/213
1,652,600 A * 12/1927 Beers ..... F25D 31/007 220/592.16
3,054,600 A * 9/1962 Marsh ..... B01F 7/1695 366/297
3,351,836 A * 11/1967 Kearns ..... B60S 1/483 318/443
4,172,365 A * 10/1979 McClintock ..... A45C 5/141 280/47.31
4,286,440 A * 9/1981 Taylor ..... A45C 11/20 206/541
4,899,553 A * 2/1990 Drummond, III ..... F25C 1/22 62/372
5,653,123 A * 8/1997 Handlin ..... F25D 3/06 62/381
2003/0160060 A1* 8/2003 Hornblad ..... A47F 5/08 221/256

(Continued)

*Primary Examiner* — Kun Kai Ma
(74) *Attorney, Agent, or Firm* — Pillsbury Winthrop Shaw Pittman LLP

(57) ABSTRACT

Included are systems, methods and devices for cooling beverages, comprising an upper insulated basin sized to allow placement of cooling fluid and beverage containers; a separator device sized to restrain the beverage containers such that during agitation, each of the beverage containers does not impact any other of the beverage containers or the side surface of the upper insulated basin and allows for cooling fluid to contact an exterior surface of each of the beverage containers; and an agitation section placeable in physical communication with the upper basin that can provide, when activated, motion to the upper insulated basin.

20 Claims, 24 Drawing Sheets

(56) References Cited

U.S. PATENT DOCUMENTS

| | | | | |
|---|---|---|---|---|
| 2006/0278541 | A1* | 12/2006 | Mendoza | B65D 71/50 206/139 |
| 2007/0012067 | A1* | 1/2007 | Kaplan | A23L 3/36 62/457.2 |
| 2007/0012068 | A1* | 1/2007 | Kaplan | B65D 81/382 62/530 |
| 2011/0005265 | A1* | 1/2011 | Edwards | F25D 31/007 62/465 |
| 2013/0068606 | A1* | 3/2013 | Lahnstein | B01F 7/00241 202/175 |
| 2013/0233011 | A1* | 9/2013 | Wolf | F25D 3/08 62/457.5 |
| 2015/0114011 | A1* | 4/2015 | Benavides | F25D 31/007 62/64 |
| 2015/0323246 | A1* | 11/2015 | Spivey | F25D 31/007 62/56 |
| 2017/0055761 | A1* | 3/2017 | Roberts | A47J 31/407 |
| 2018/0310589 | A1* | 11/2018 | Sosa | F25D 31/007 |

* cited by examiner

600

600

600

600

SUPERCOOLING AGITATING BEVERAGE CONTAINER

CROSS REFERENCE TO RELATED APPLICATIONS

This Application claims priority to U.S. Provisional Patent Application 62/757,334, filed Nov. 8, 2018.

BACKGROUND

1. Field of the Invention

This invention related to the beverage cooling arts, specifically reducing bottled or canned beverages to sub-freezing temperatures.

2. Description of the Related Art

Bringing a fluid to lower-than-freezing temperatures is a delicate task because crystallization tends to form at the freezing point. There are ways to reduce fluids below standard freezing points by rapidly dropping temperatures, controlling air pressure around the fluid, altering the freezing temperature by adding a solute, and denying a fluid a nucleation point.

Beverages are enjoyed and often marketed for consumption at extremely low temperatures. Traditional coolers can bring temperatures low through placing containers in ice and restricting heat transfer through insulation and capping to restrict air flow. Electric freezers can bring fluids to low temperatures through the cyclic use of compressor, condenser, evaporator and expansion valve. These methods of cooling beverages are often incapable of fine-tuning to beverage-specific use, are not portable and easily transportable, and are not specialized to prevent nucleation.

The existing ways of greatly reducing beverage temperatures to below freezing temperature are cumbersome, not easily portable, not specialized for the purpose of individually sized beverages, and risk spontaneous crystallization through stationary liquid, accidental impact, or excessive cooling. Some of the foregoing aspects are addressed in the following disclosure.

SUMMARY

Some or all of the foregoing problems in the art are addressed through a two part cooling system for circulating fluids cooled below beverage freezing points. The top segment of the present invention includes in some embodiments an insulated basin with immobilizing holders for spaced beverage bottles to hold fluids that remain in liquid form at temperatures below the freezing temperature of the beverages, such as highly salted iced water brine with a lower freezing temperature than beer. To promote circulation of the brine and prevent crystallization of the beverages, the top segment is placed on a powered base, allowing for constant movement of the brine and the beverages. The moving base can be powered and can impart reciprocal or linear motion onto the top segment to circulate the brine between the bottles and to ensure the beverages do not become solid until desired.

The foregoing design takes advantage of the property of water-based fluid's tendency to remain unfrozen at temperatures well below the regularly understood freezing point. While water may become solid at 32° F., it does not have to become solid until a temperature far below that. That liquid is termed 'supercooled.' Liquid water can reach temperatures as low as minus 55° F., at which point it must become solid. It is at this temperature that the molecular structure of water changes physically to form tetrahedron shapes, with each water molecule loosely bonded to four others. Below the traditionally understood freezing temperatures (i.e., 32° F., 0° C.) ice forms when a small nucleus provides a center on which ice crystals can form. Otherwise, water can be cooled until it reaches its homogenous nucleation temperature, a number far below the typical freezing point. A nucleus for crystallization can be provided by many things, including a shock wave caused by impact, as is one intended use of the teachings of the present disclosure.

BRIEF DESCRIPTION OF THE FIGURES

The above-mentioned aspects and other aspects of the present techniques will be better understood when the present application is read in view of the following figures in which like numbers indicate similar or identical elements.

Figure 1A:
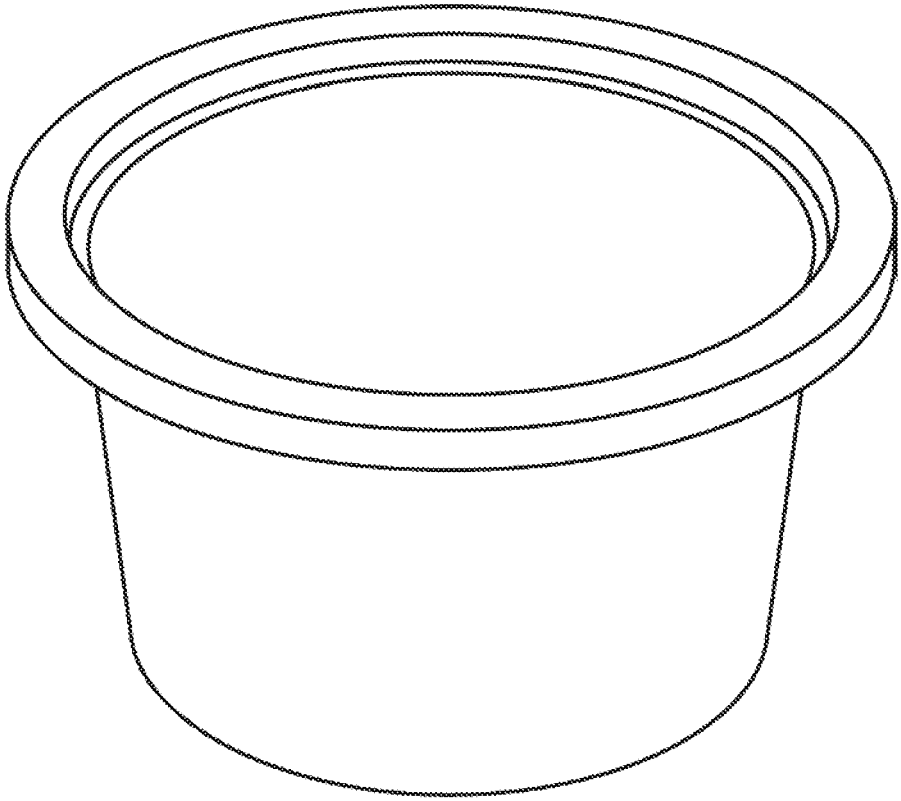
FIGS. 1A-IC are an array of drawings of an embodiment of the top outer shell under and embodiment of the present disclosure, and a sectional view of the same.

Where appropriate, sectional views are included and are to be interpreted as continuous of the designs or patterns shown therein, unless specifically described otherwise. That is, pieces appearing as cylindrical sectioned are to be interpreted as continuing cylindrical shape throughout. Where there is conflict in interpretation of a sectional view and a more complete view, the more complete view should be assumed to control. Where there is a conflict in interpretation of a written description and a figure, the written description should be assumed to control. Where descriptions are of geometric or spatial terms, strict mathematical interpretation of those terms is not intended.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION

To mitigate the problems encountered in beverage cooling as described herein, the inventors had to both invent solutions and, in some cases just as importantly, recognize problems overlooked (or not yet foreseen) by others in the fields of supercooling liquids, beverage cooling, and consumer products. Indeed, the inventors wish to emphasize the difficulty of recognizing those problems that are nascent and will become much more apparent in the future should trends in the foregoing industries continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

Some embodiments of this present disclosure include a two part cooling system for circulating fluids cooled below beverage freezing points. The top segment of the present invention includes in some embodiments an insulated basin with immobilizing holders for spaced beverage bottles, within the basin and between the bottles is sufficient space to hold fluids that remain in liquid form at temperatures below the freezing temperature of the beverages, such as highly salted iced water brine with a lower freezing temperature than beer. To promote circulation of the brine and prevent crystallization of the beverages, the top segment is placed on a rotating base. The moving base can be powered and can impart reciprocal or linear motion onto the top segment to circulate the brine, to keep an even distribution of the brine between the bottles, and to ensure the beverages do not crystalize prematurely or at all. In a preferred embodiment, the top segment comprises four main parts, an outer shell 100, an inner lining 300, insulation, and a beverage separator 500. In a preferred embodiment, the bottom segment comprises a rotating head, a rotating mount, a motor with a power source, and a base motor housing. In this embodiment, the two segments are held together by gravity and can be separated without tools and without latches by lifting the top segment off the bottom segment.

Unless the context clearly means otherwise, throughout this specification, the terms upper, top, upward, down, lower, downward, and bottom are intended to mean the corresponding direction with respect to a fully assembled device made under the teachings of this disclosure placed upright and sitting on its lower base.

Figure 1B:
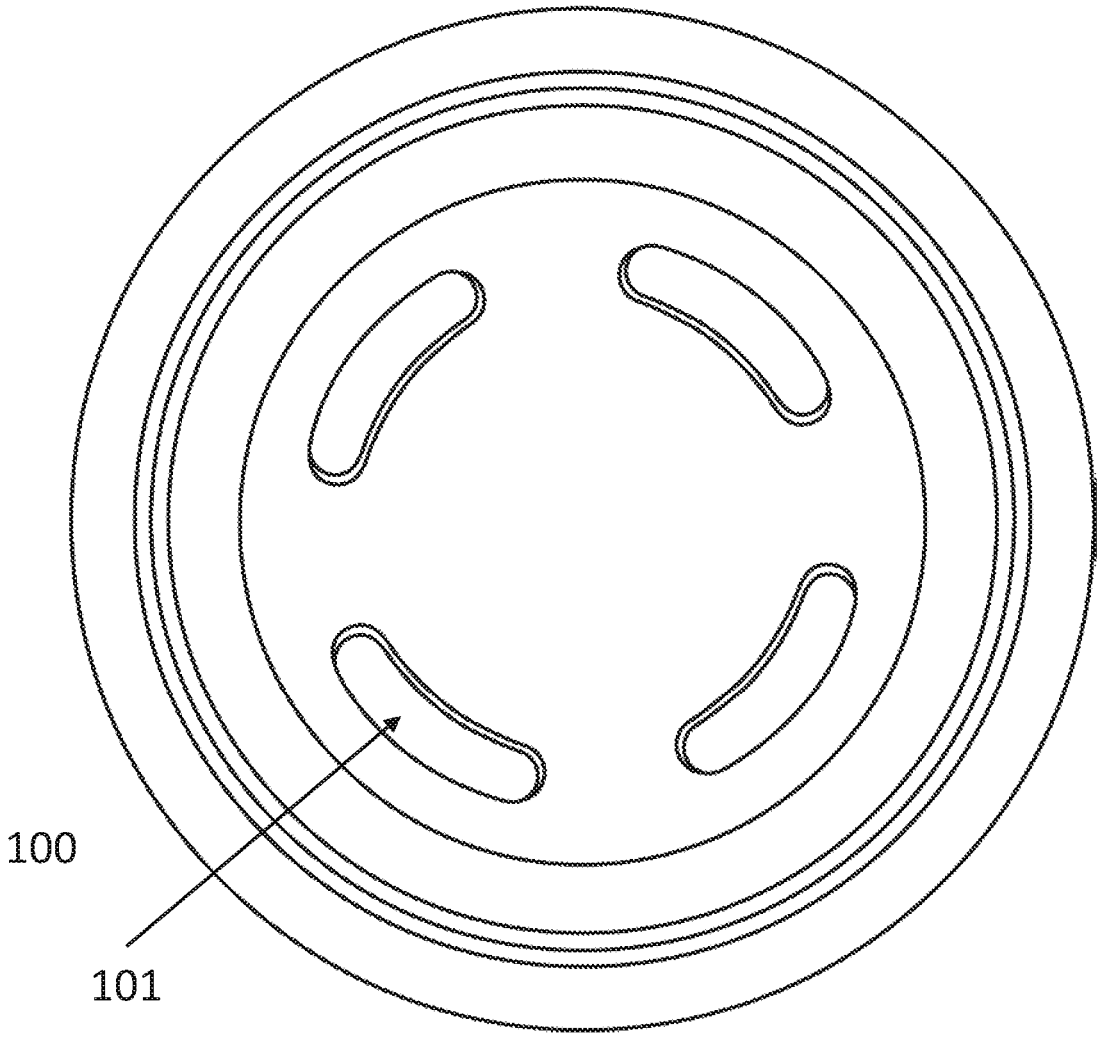
Figure 1C:
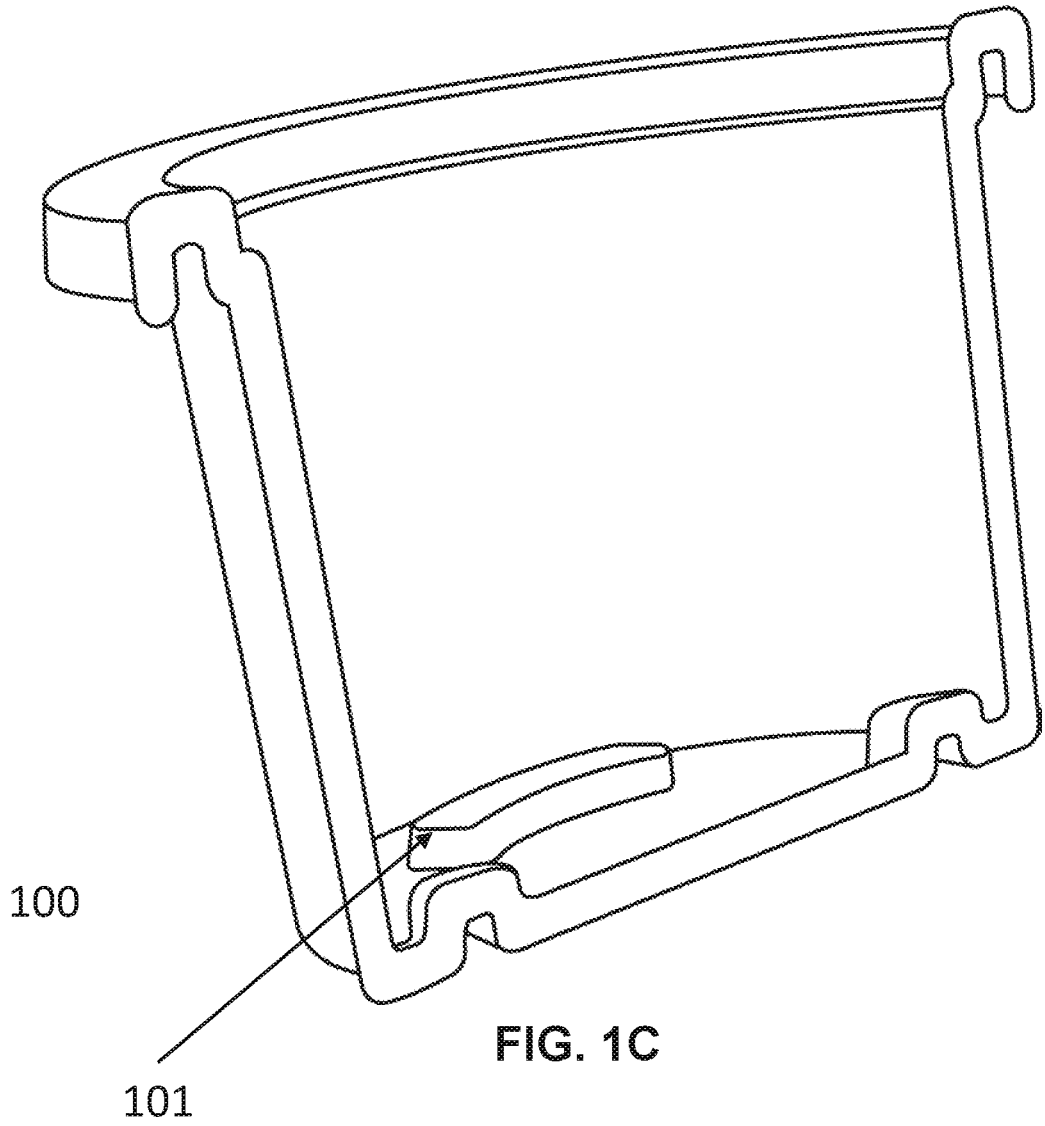
Figure 2A:
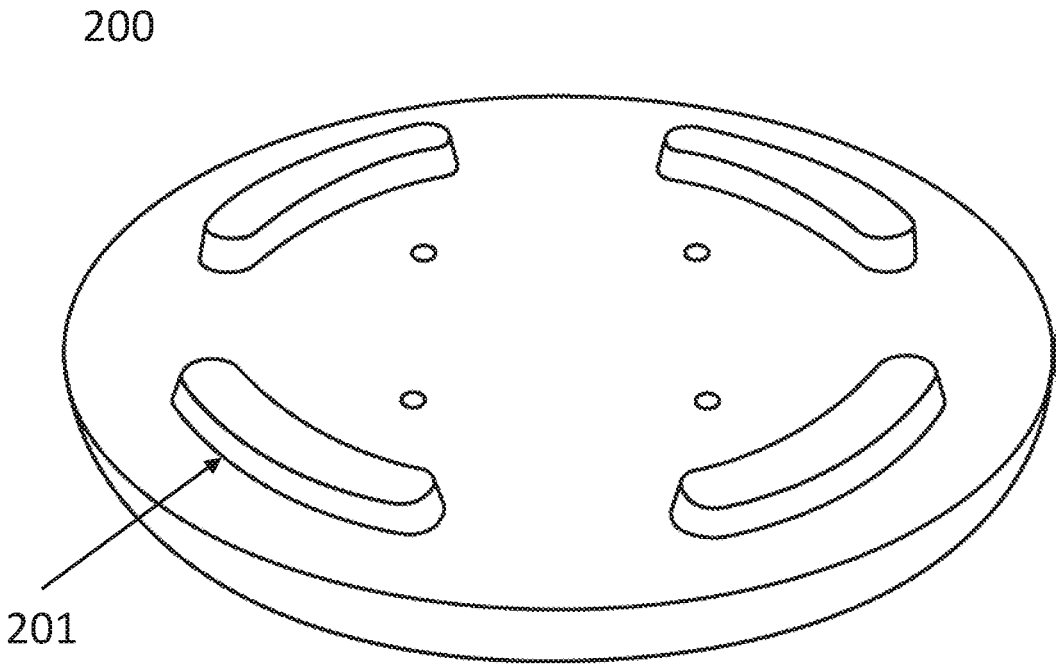
FIGS. 2A-2D are an array of drawings and sections of the rotating head under an embodiment of the present disclosure.
Figure 2B:
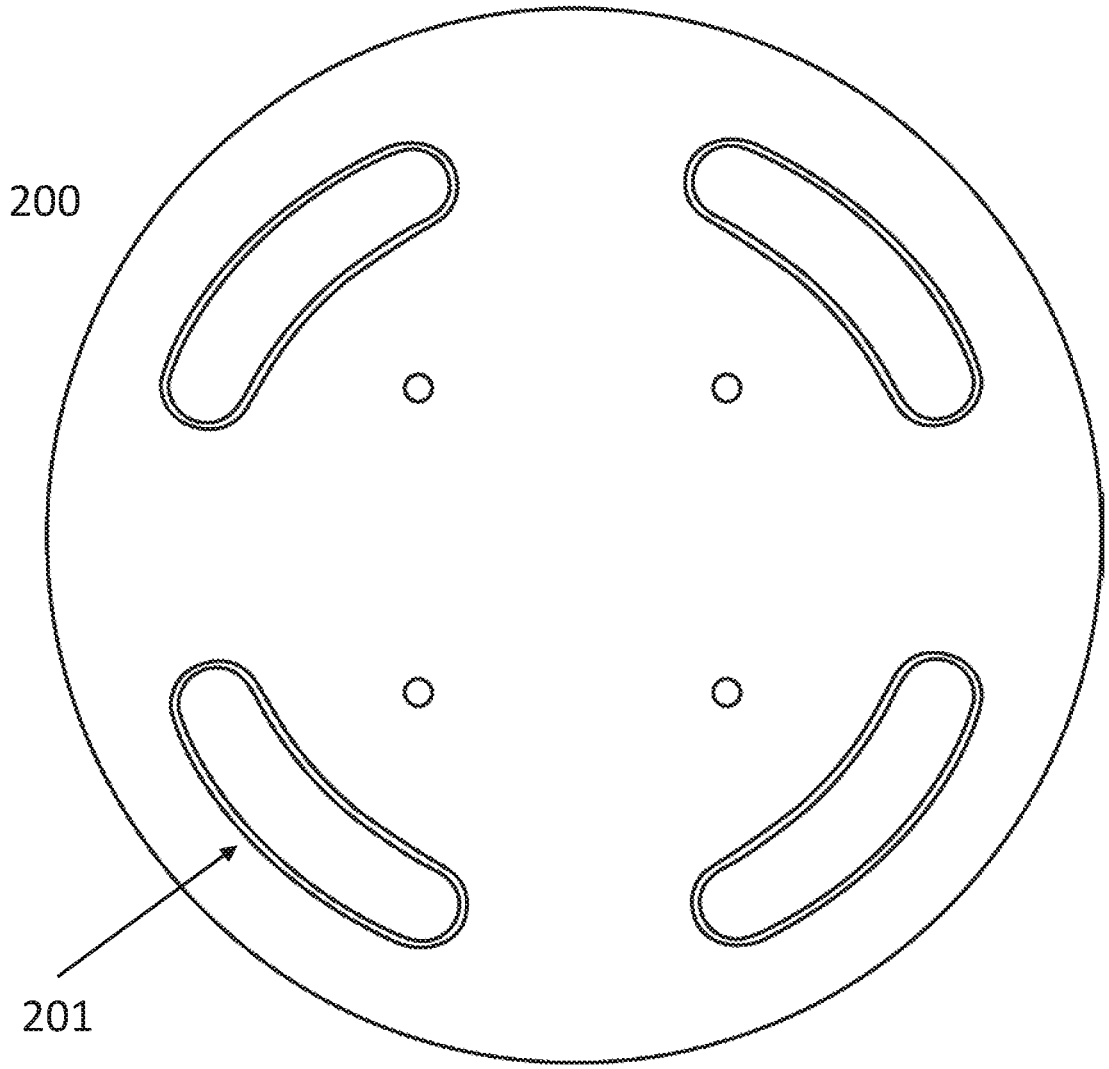
Figure 2C:
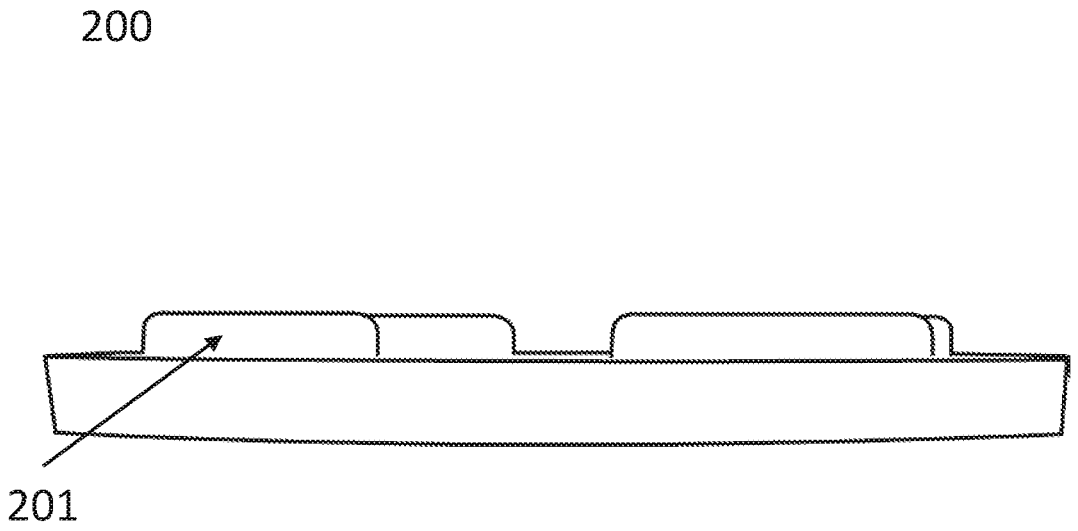
Figure 2D:
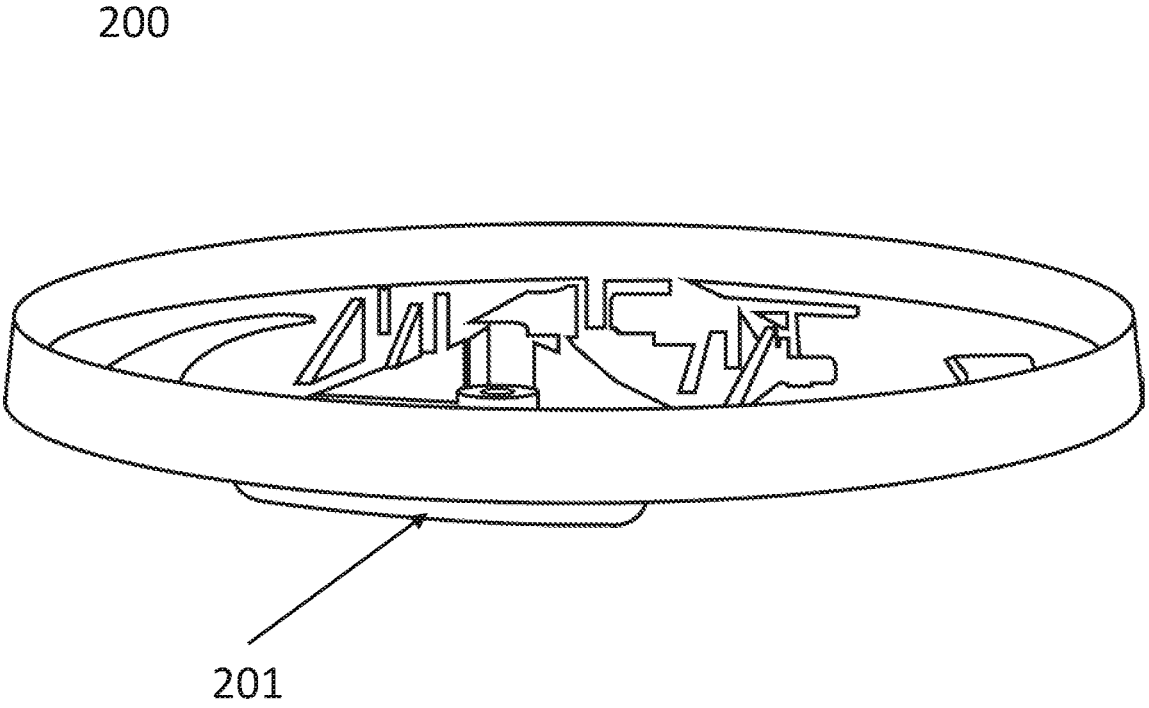
Figure 3A:
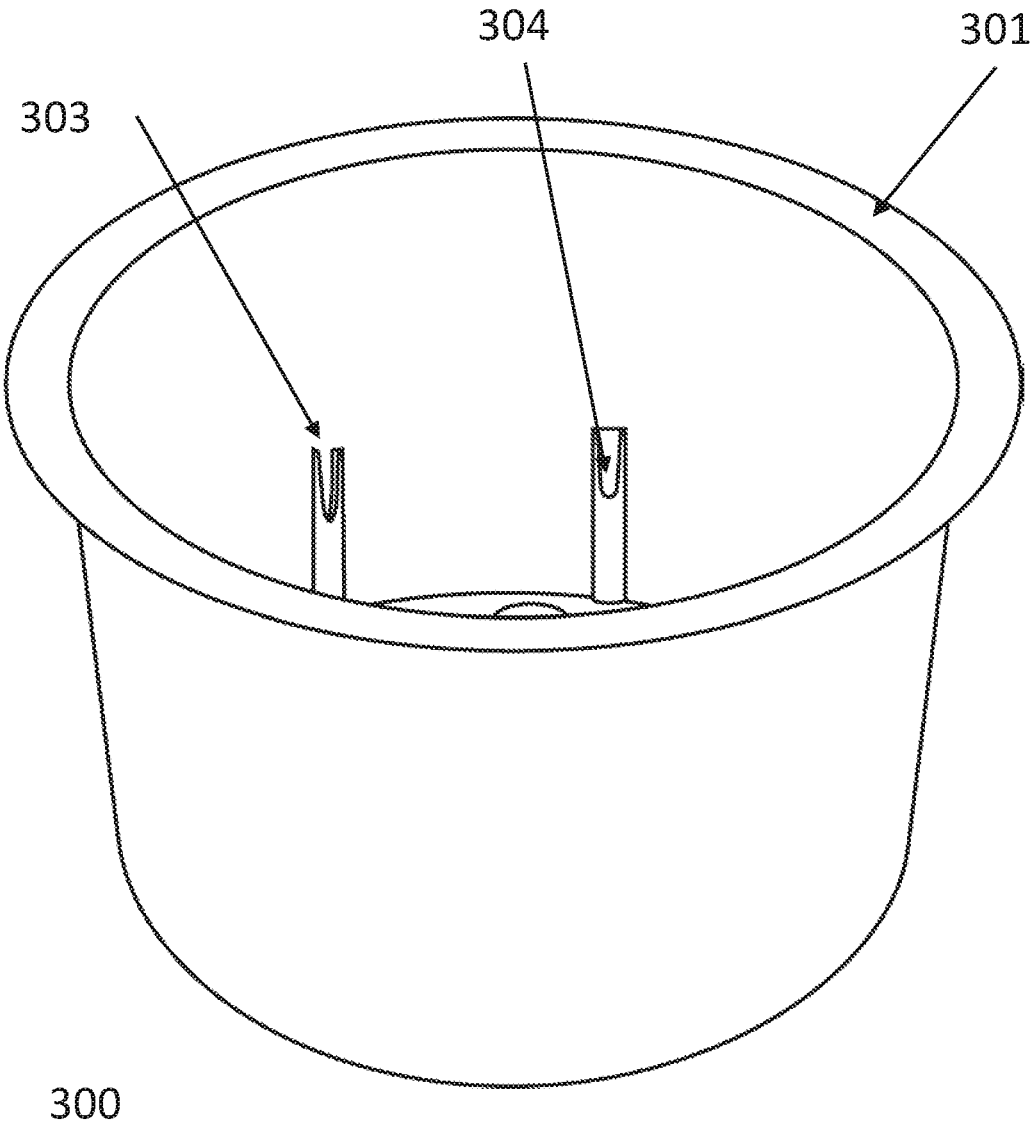
FIGS. 3A-3E are an array of drawings of the top inner lining under an embodiment of the present disclosure.
Figure 3B:
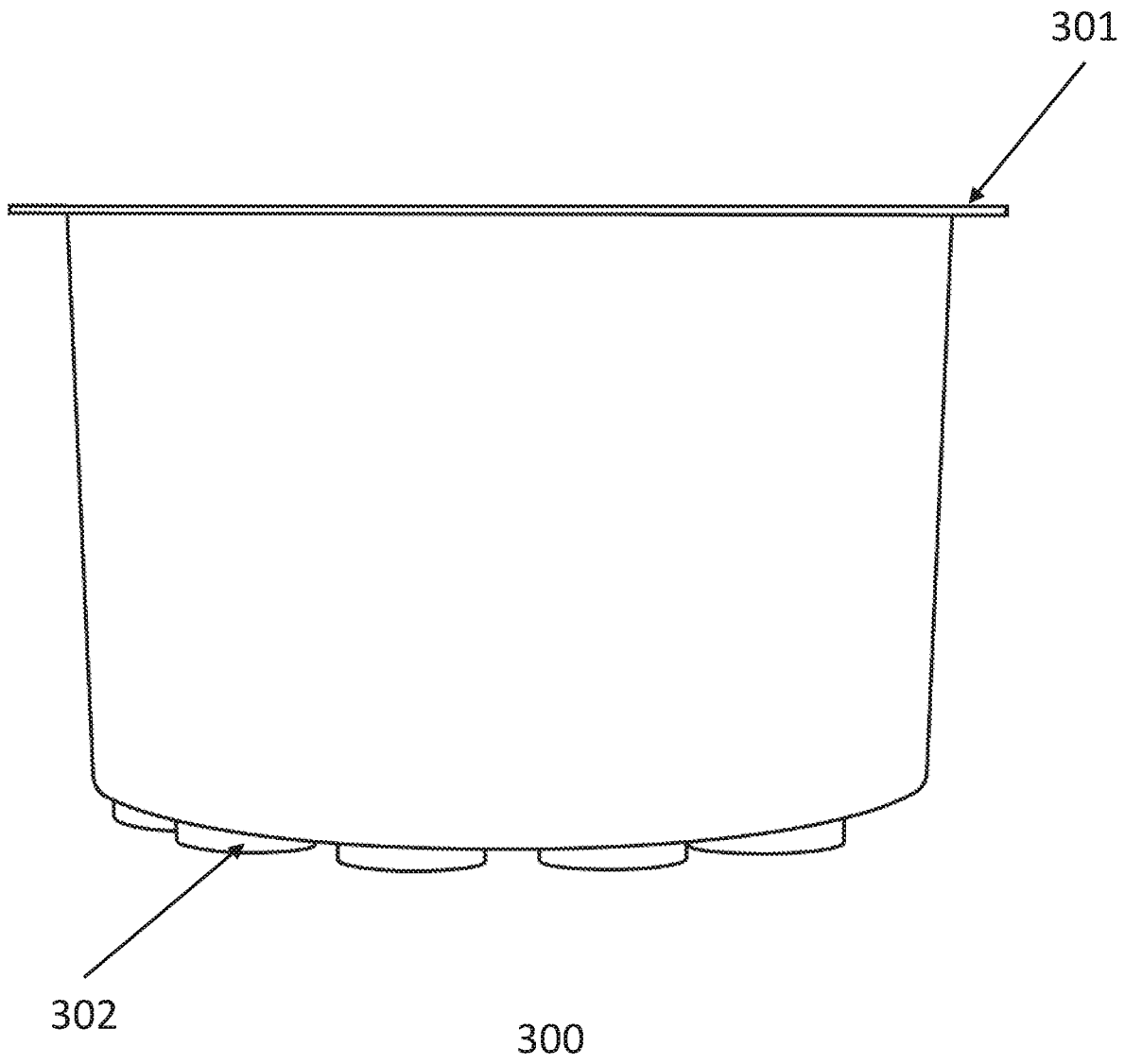
Figure 3C:
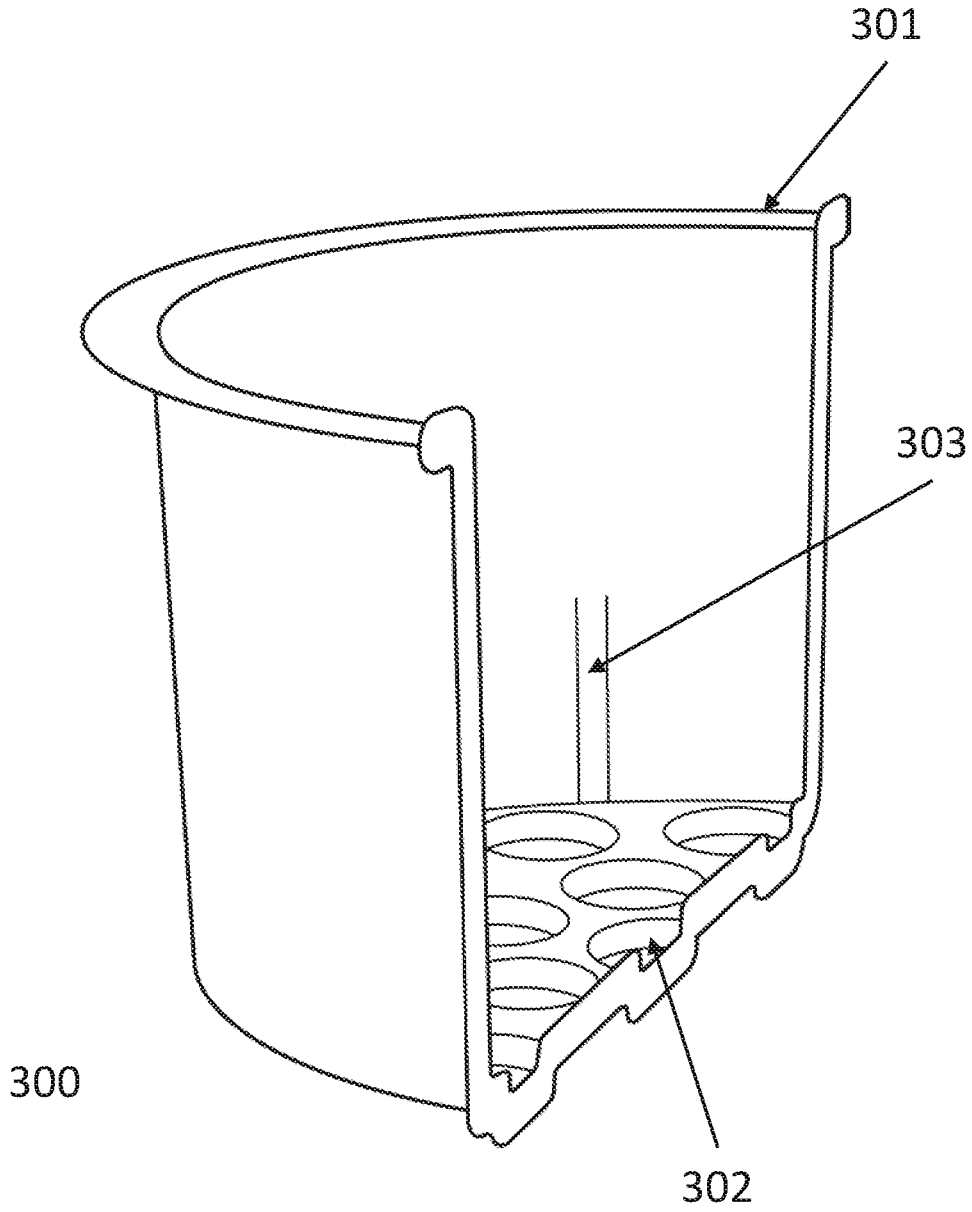
Figure 3D:
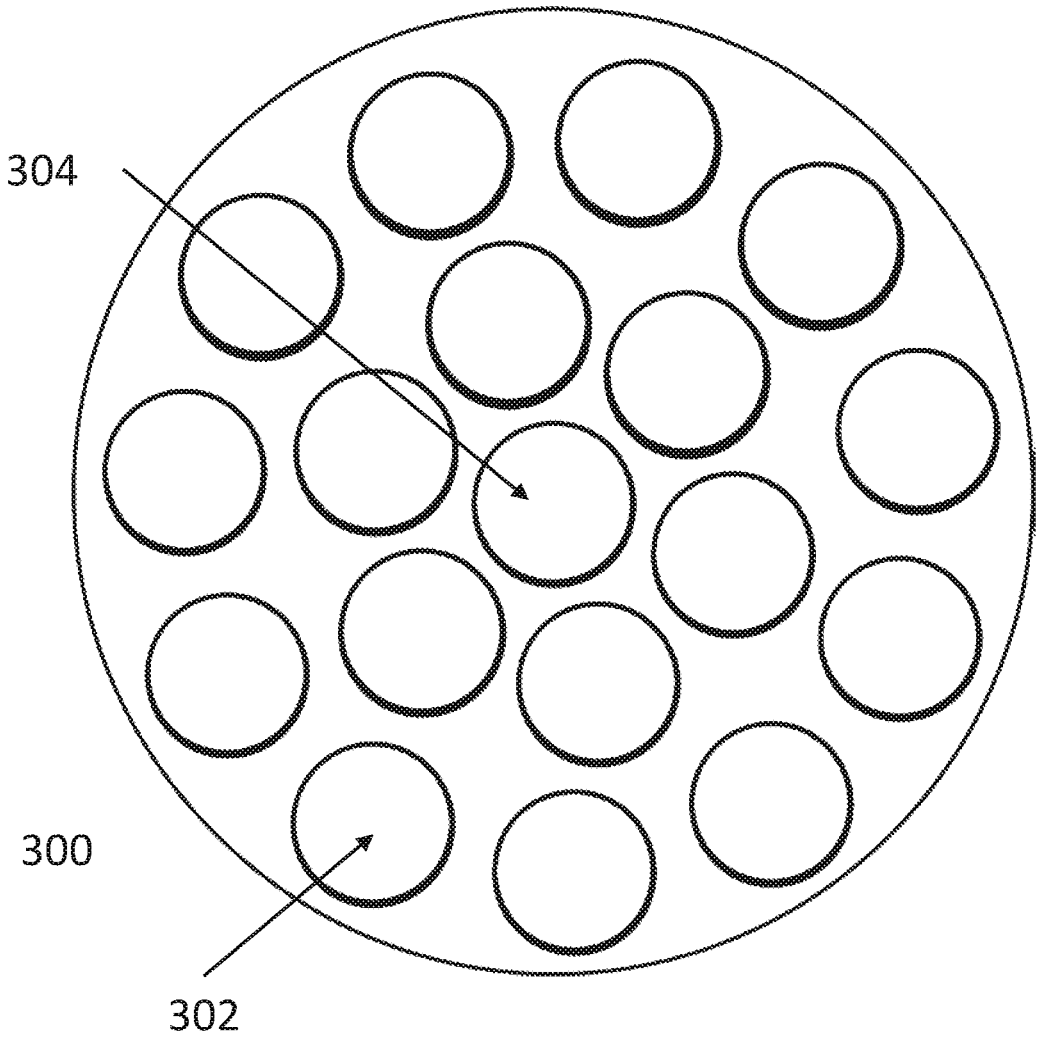
Figure 3E:
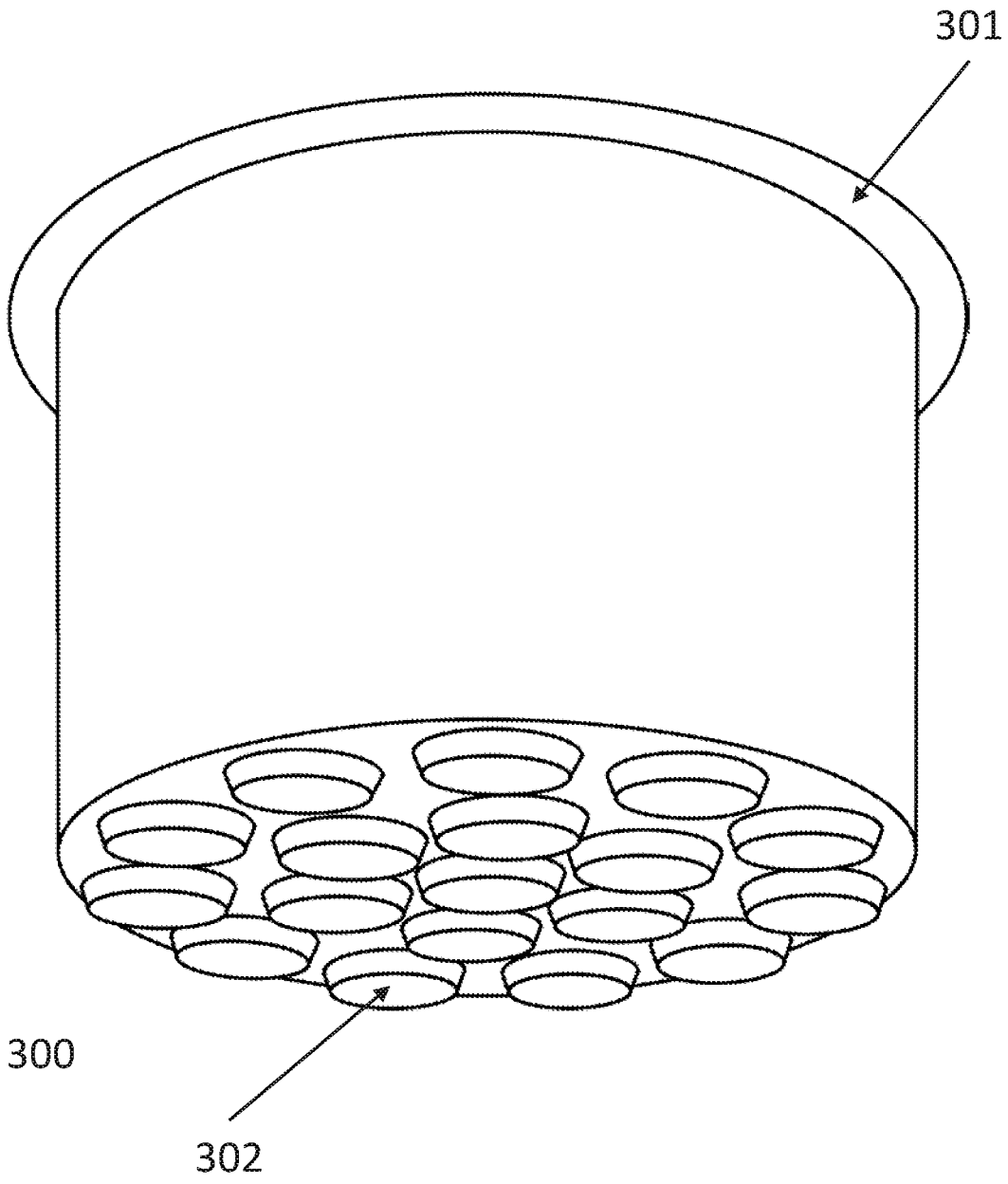
Figure 4A:
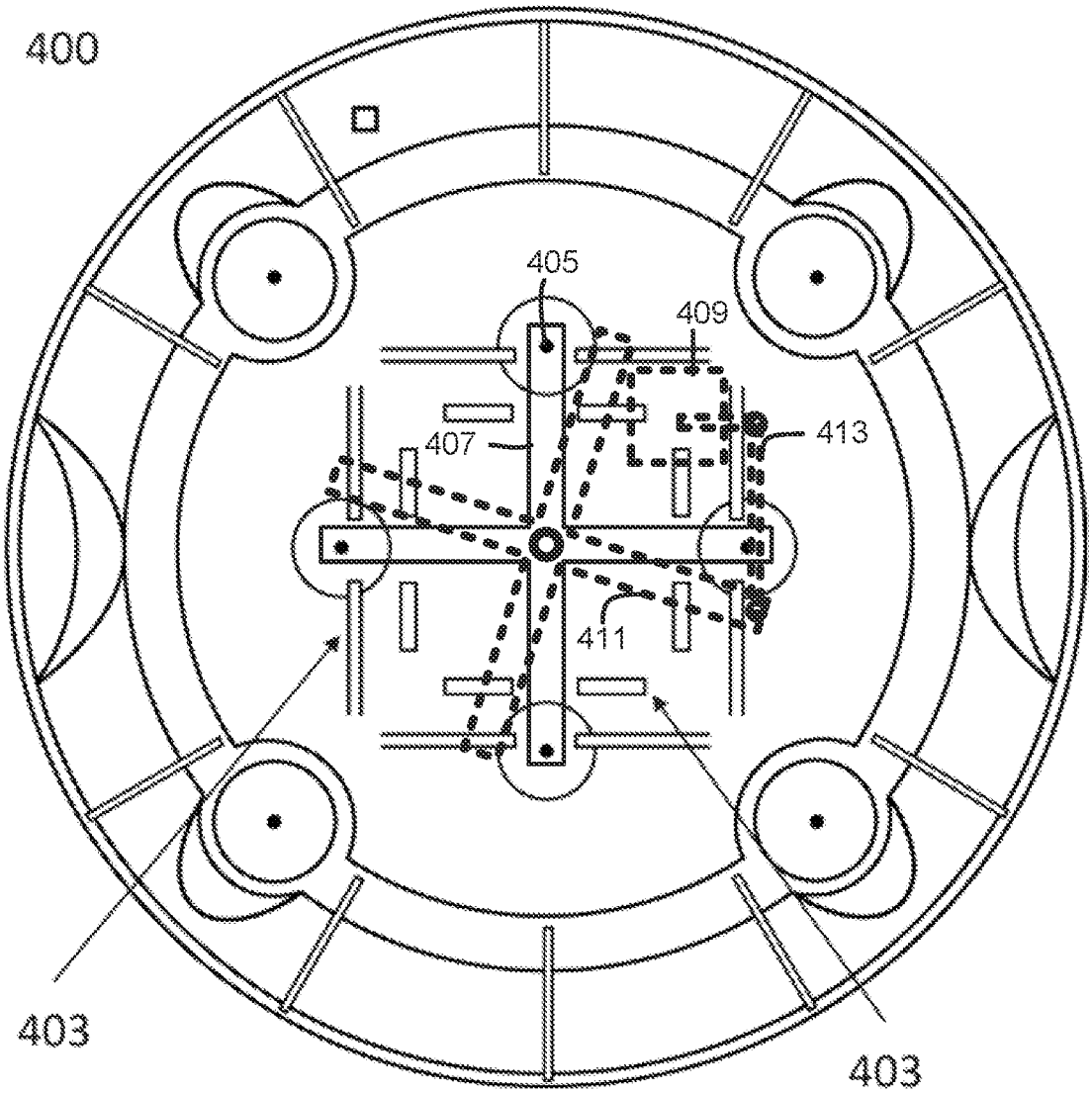
FIGS. 4A-4D are an array of drawings of the motor housing stand under an embodiment of the present disclosure.
Figure 4B:
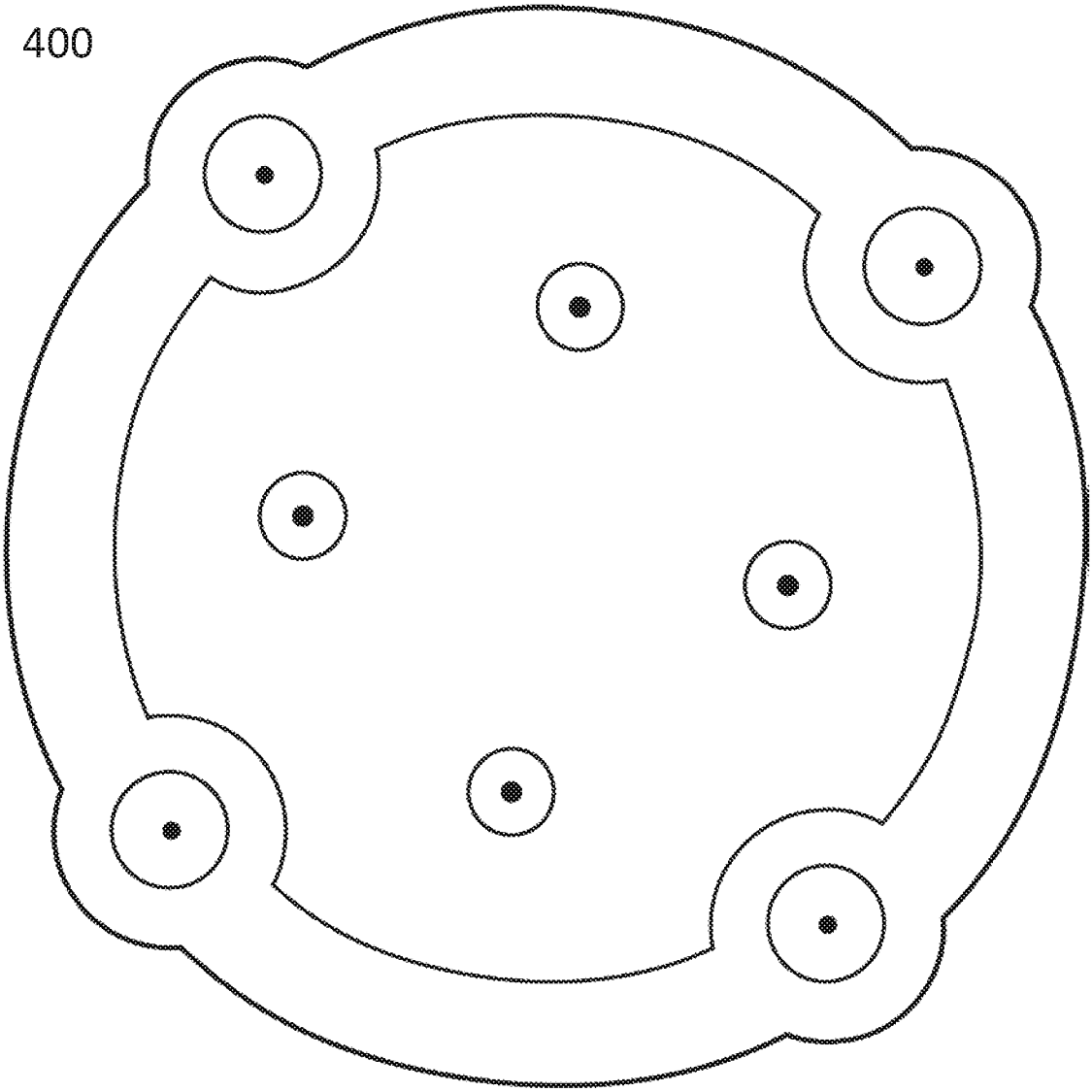
Figure 4C:
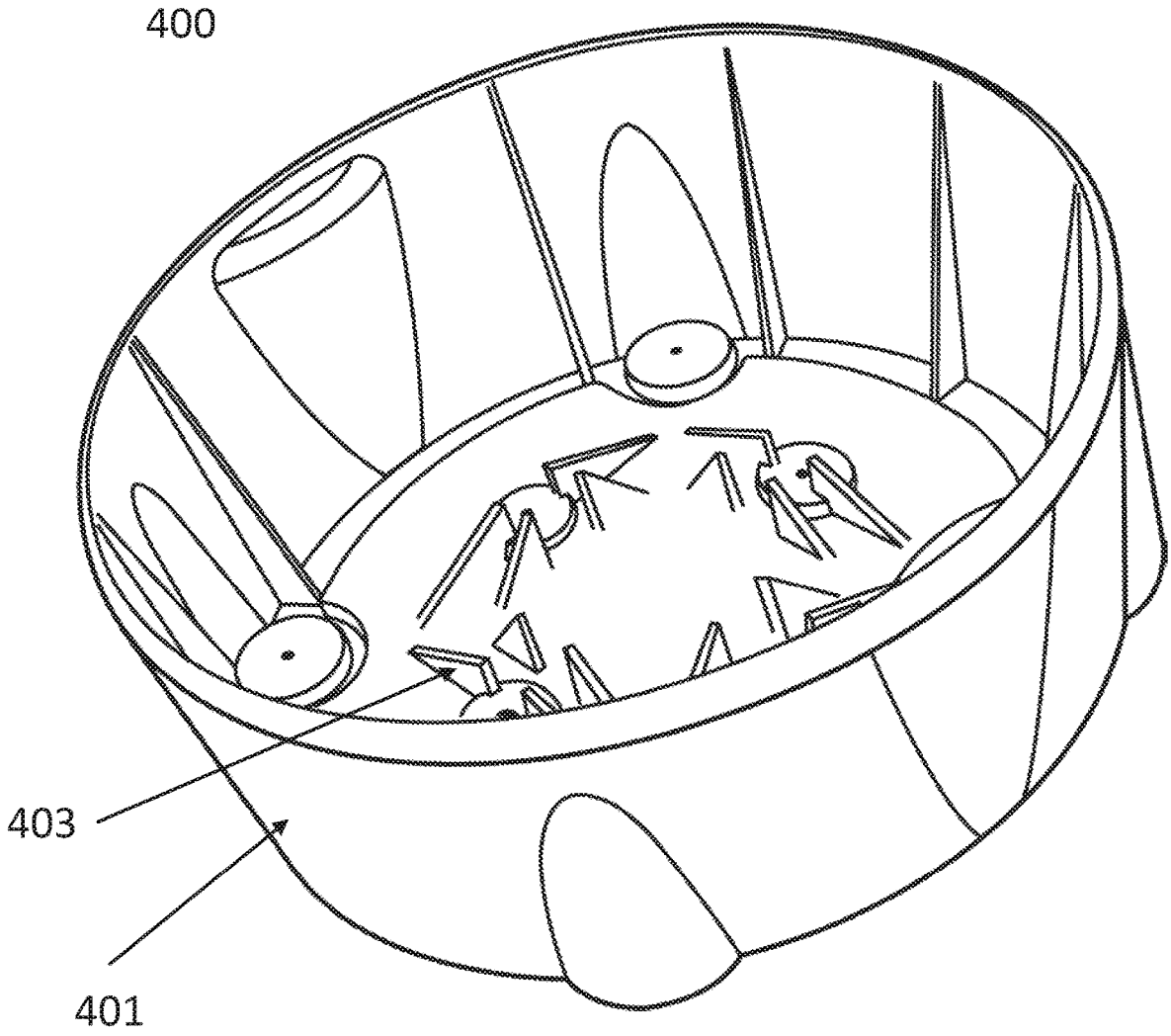
Figure 4D:
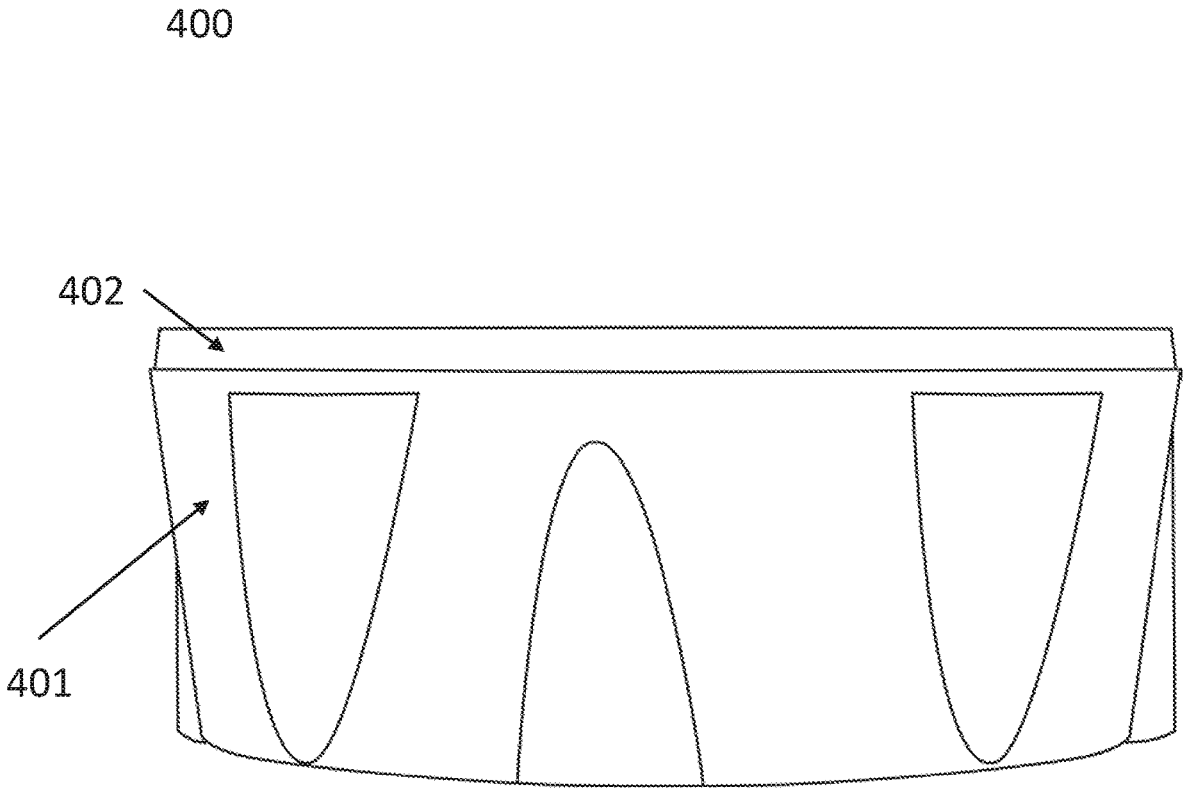
Figure 5A:
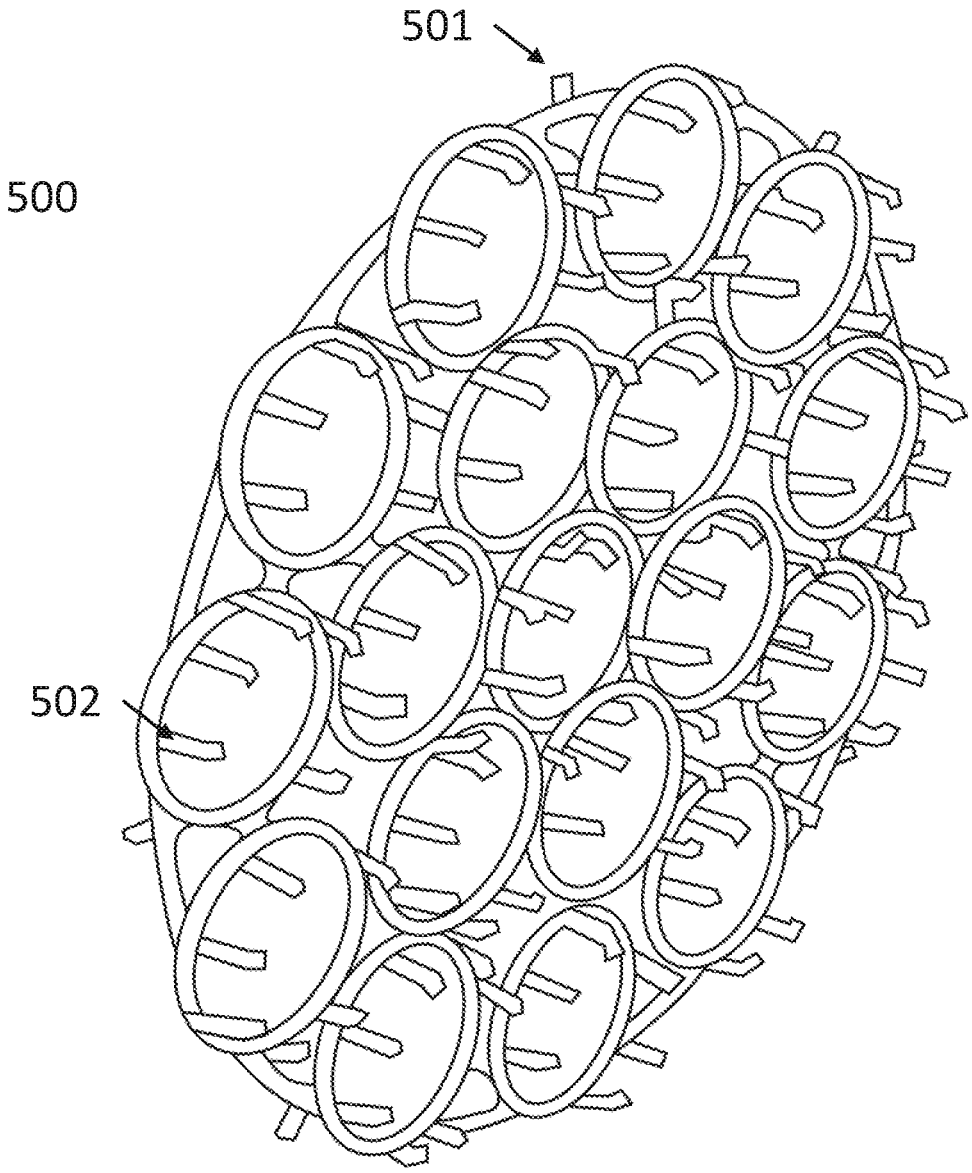
FIGS. 5A-5D are an array of drawings of the beverage separator under an embodiment of the present disclosure.
Figure 5B:
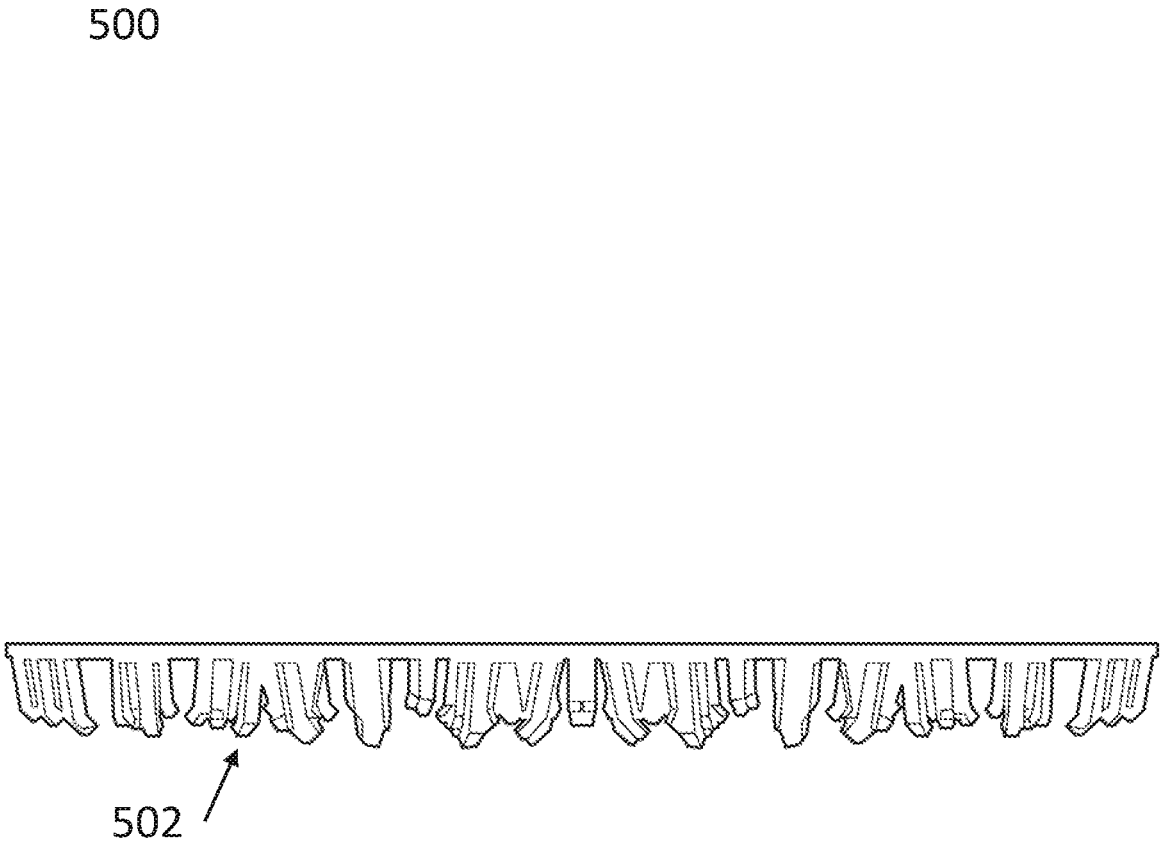
Figure 5C:
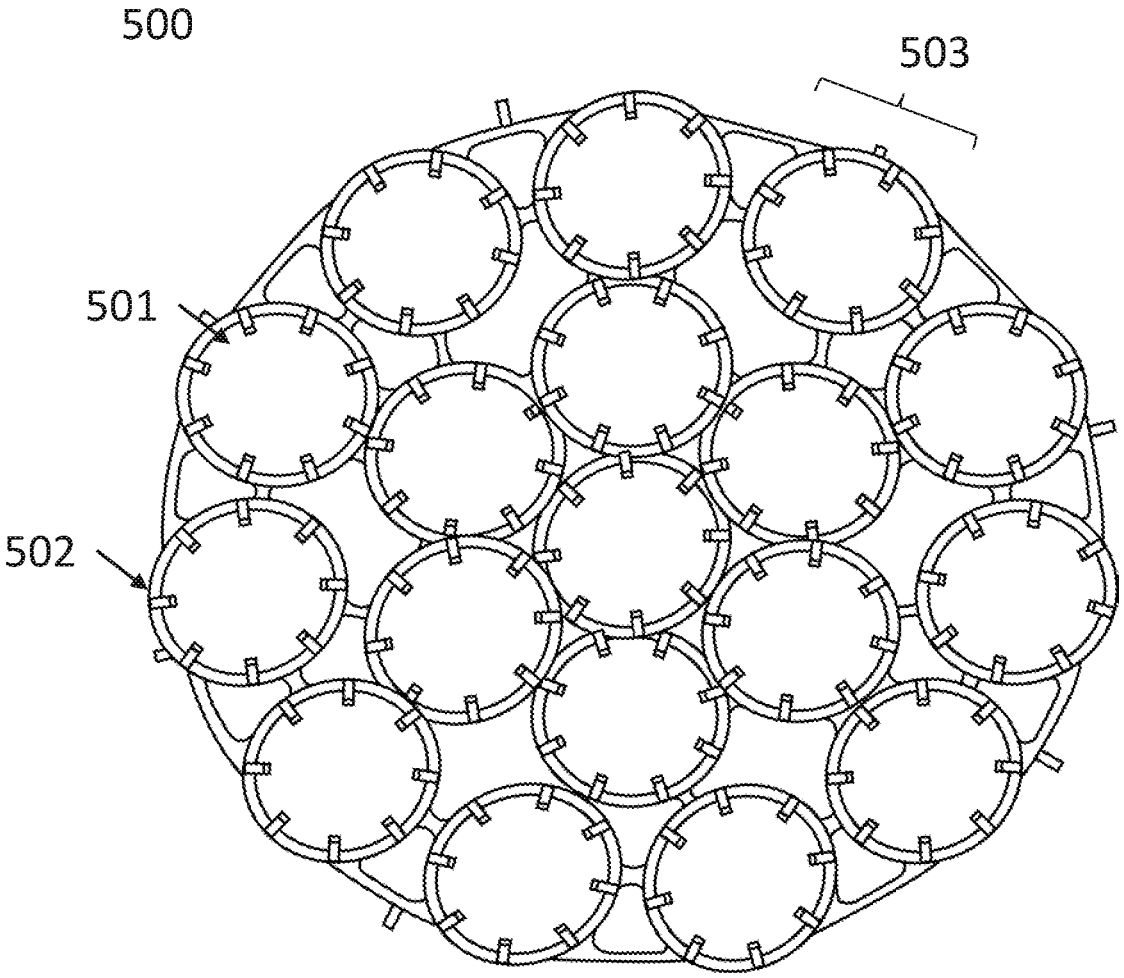
Figure 5D:
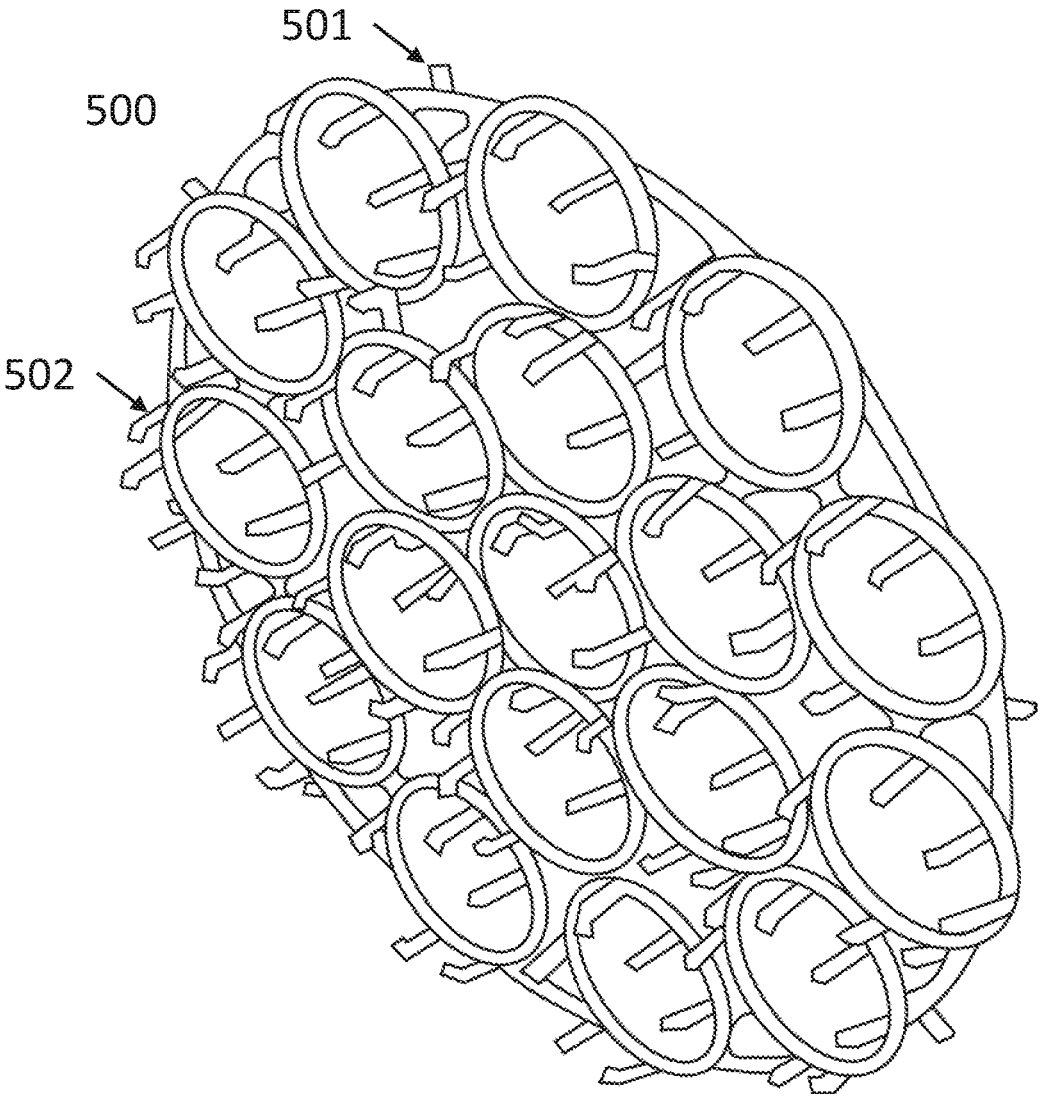
Figure 6A:
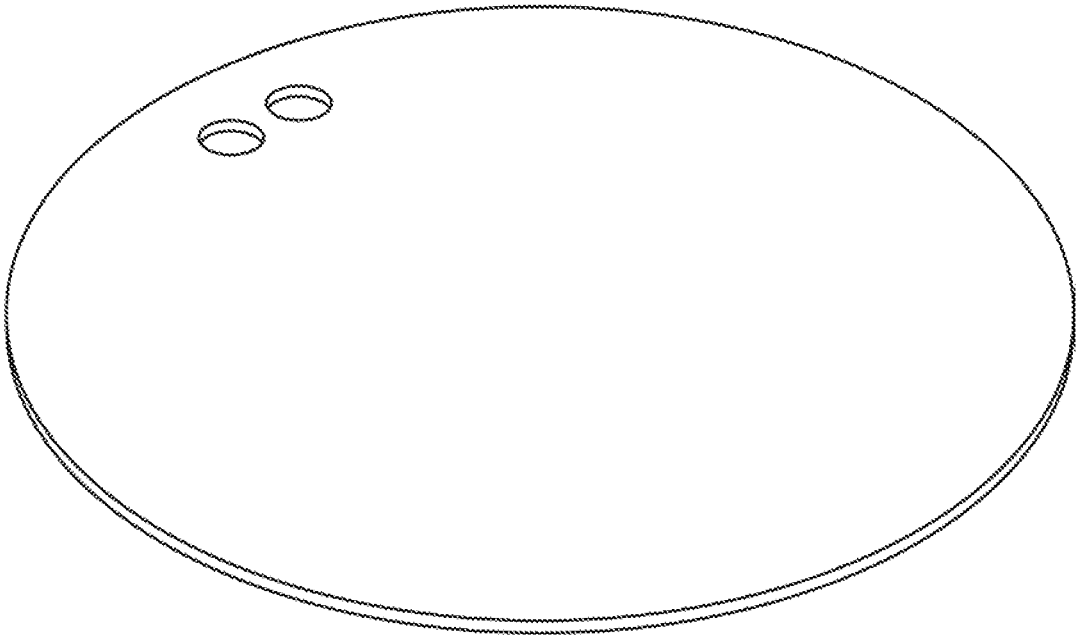
FIGS. 6A-6D are an array of drawings of the lid under an embodiment of the present disclosure.
Figure 6B:
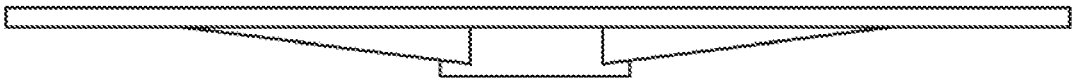
Figure 6C:
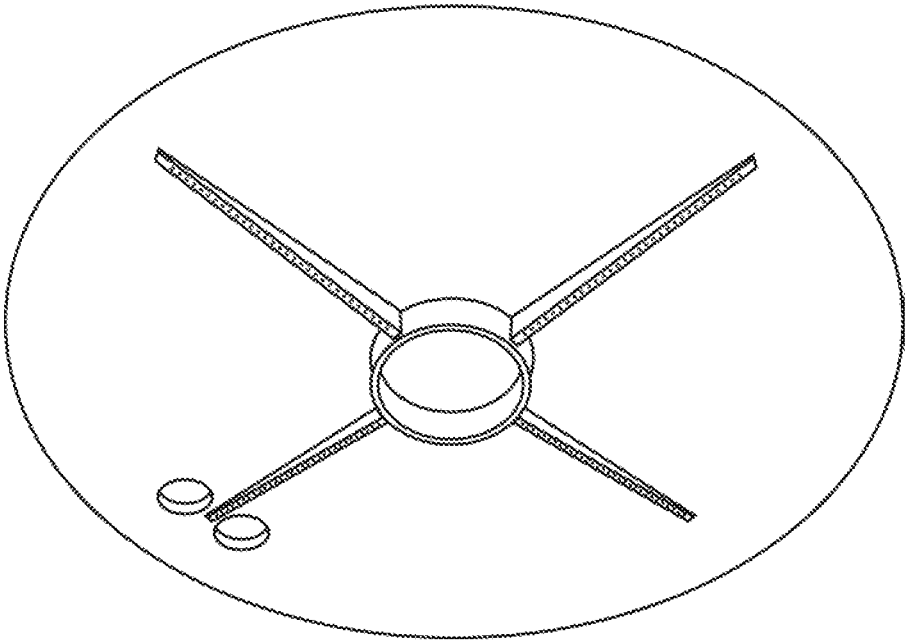
Figure 6D:
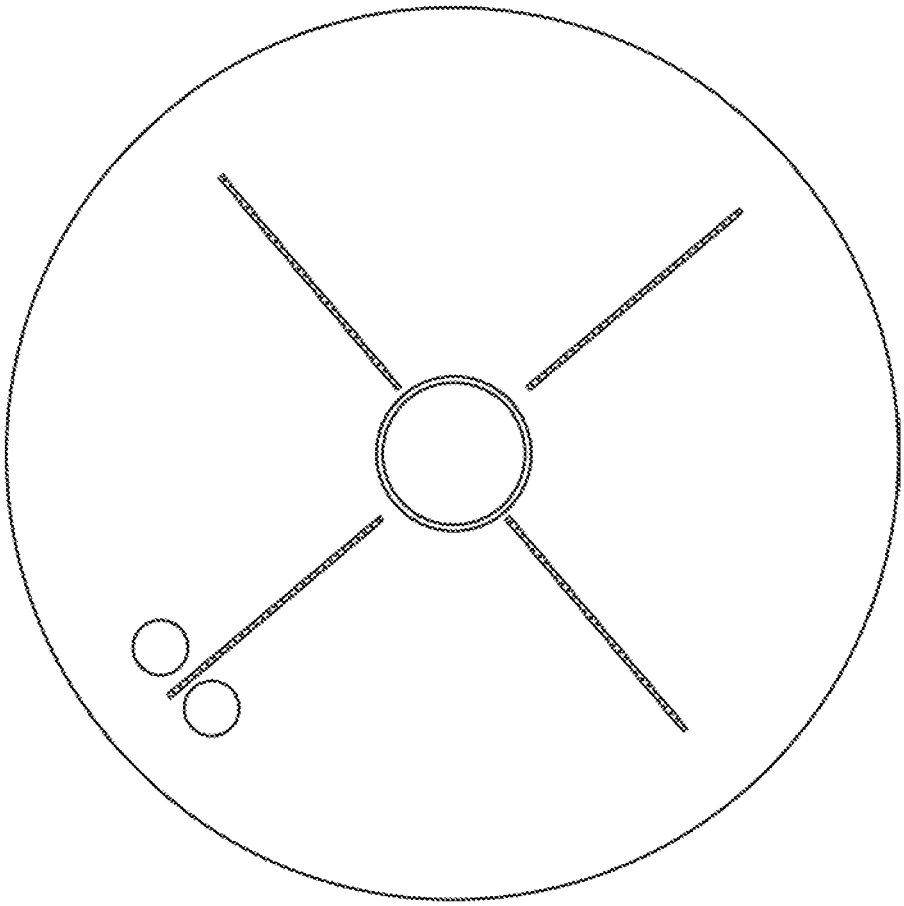

In some embodiments, the upper body of the cooler comprises a substantially cylindrical hollow insulated tub. The top of the upper body is open to allow for the insertion and removal of beverages. The tub is insulated. In some embodiments, the body comprises three main parts, the outer shell 100, the inner lining 300 and insulation layer. One embodiment of the outer shell 100 is shown in FIGS. 1A, 1B, and 1C. In some embodiments the insulating ability of the cooler derives substantially from a substantially cylindrical insulation layer insert placed between the inner lining 300 and the outer shell 100 of the insulated tub. The insulation is preferably foam but can including any similar light-weight materials suitable for reducing heat transfer, e.g., polystyrene, cork, and polyurethane. In some embodiments, the upper body also comprises a lid, which substantially covers the top of the inner lining 300, reduces air flow into and out of the interior portion of the upper body of the cooler and blocks sunlight, reducing convection and radiation heat transfer. An embodiment of the lid is shown in FIGS. 6A, 6B, 6C, and 6D.

The inner lining layer 300 of the cooler can be generally cylindrical and sized appropriately to create an inner volume to hold the beverage containers and cooling fluid. One embodiment of the inner lining layer 300 is shown in FIG. 3A-3E. In one embodiment, it is sized to hold eighteen beverage containers (e.g., bottles) arranged in three concentric circles with sufficient additional diameter to contain a beverage separator 500, with spacing between each container for supercooling fluid to be circulated. In some embodiments, the inner lining 300 also comprises a top lip 301 that, when the lining 300 is placed within the outer shell 100, between the two is an enclosed space where the insulation layer can fit. The bottom of the inner lining layer 300 in this embodiment contains depressions 302 sized and spaced to fit the beverage containers. In this embodiment, the inner wall or side of the inner lining 300 contains integral slots 303 that are sized and shaped to align with keys 501 on the beverage separator 500. The slots 303 are positioned vertically such that the bottom of each slot (e.g., at location 304) serves a support for the beverage separator ring 500 to keep it above the base of the inner lining layer 300. The slots 303 are positioned along the inner circumference of the inner lining layer 300 such that placement of the beverage separator keys 501 into the lining layer slots 303 aligns the beverage separator 500 with the depressions 302 in the base of the lining layer 300. This arrangement aligns the pieces such that when this embodiment is used, it places two areas of contact for each beverage container, vertically displaced: the depression 302 is sized to fit the bottom of the bottle and the corresponding beverage separator section holds the beverage container nearer its vertical midpoint. These two points of contact reduce the likelihood of tipping or bottle-to-bottle contact when the device is operating and reciprocating. In some embodiments, the depressions 302 in the bottom of the inner lining layer 300 are tapered to allow various sizes of beverage containers to fit.

In some embodiments, the inner lining layer 300 is formed of an approximately constant 0.125 inch thick suitable plastic material. It can follow a slightly tapered cylindrical path to allow for ease of removal from mold when molded manufacture is selected and for ease of use allowing more space for bottle removal.

In one embodiment, the diameter of the inner liner at its widest point is 19.750 inches including the lip, and 12.125 inches tall. In this embodiment its inner diameter at the top, from the inside surface to inside surface is 17.286 inches. Because of the slight taper, in this embodiment its inner diameter at the bottom from inside surface to inside surface is 16.754 inches. In other embodiments, the inner lining layer 300, insulation, and outer shell 100 are all changed to fit the expected uses including particular beverage bottles including soft drinks, beer, wine, alcohol, water, and others. These modifications can be based on the height of the beverage containers, the number of beverage containers, the amount of fluid to be used, and otherwise.

In the described embodiment, the outer shell 100 is sized and shaped to fit the inner lining layer 300 within and leave space along its circumference for insulating material. One embodiment of the outer shell 100 is shown in FIG. 1. In this embodiment, the outer shell 100 will have substantially the same taper as the inner lining 300 such that a constant thickness area between the two is formed and for similar benefits for ease of manufacture and removal in a mold. In this embodiment, the bottom of the outer shell 100 has four slots 101 sized to fit with corresponding tabs in the rotating head. The slots 101 and tabs are sized and shaped to transfer rotational force from the motor in the lower section to the upper section. The slots 101 can be sized and shaped in any suitable manner to transfer the rotational energy of the rotating head to the main body. Other utility of the slots 101 is that they serve as an easy and nearly immediate placement of the upper body onto the rotating head with correct alignment, and they allow the device to be disassembled and reassembled with no tools and relying only on gravity to maintain the assembly. In one embodiment, there are four slots 101, approximately in the shape of arcs centered about the center-point of the outer shell 100, each approximately 450. This disclosure encompasses many embodiments of slots 101, differing in size, shape or number, or other appropriate means for transferring the rotational or other directional energy from the moving (e.g., rotating) head to the body of the cooler. The numerous other ways to transfer rotational energy include fasteners, clips and clamps. In such embodiments, the other means for transferring rotational energy can be used in lieu of the slots 101 or in addition to the slots 101. Other embodiments include a unitary construction between the motor and the cooler body, obviating any need for slots 101 or other means to transfer rotational energy. This embodiment includes a unitary piece that directly connects the motor to the upper section.

In a preferred embodiment, the outer shell 100 has a height of 14.875 inches. The outer shell 100 can have at its widest point at top a diameter of 23.000 inches an inner diameter of 19.750. Here, the inner diameter matches the largest outer diameter of the inner lining 300 which allows the two to be placed together and result in a tight fit. The outer shell 100 has a shelf in this embodiment that extends from the diameter of 18.971 inches to the inner diameter of 19.750. This sizing allows for the inner lining 300 to be placed within the outer shell 100 and have approximately 0.779 inch overlap of the inner lining lip with the shelf. As with the inner lining, in this embodiment the outer shell 100 is constructed of 0.125 inch material. It can taper downward with a bottom diameter of 19.217 inches, which in this embodiment would be the appropriate width to match the taper of the inner lining. The slots 101 each have a height of 0.875 inches in this embodiment.

There are a variety of suitable insulation materials for the including but not limited to polyethylene and polystyrene. In some embodiments, the inner lining 300 and the outer shell 100 are of unitary construction and the insulation can include vacuum. The insulation in some embodiments is of two-part construction, one approximating a curved surface of a cylindrical to fill the space circumferential to the inner lining 300 and one approximating the flat surface of a cylinder beneath the bottom of the inner lining, both of appropriate thickness. In some embodiments, the insulation is of single construction as both the curved and flat surface of the cylinder of adequate thickness. In some embodiments, the insulation layer is added after assembly of the upper section and pumped into the space between the inner lining 300 and outer shell 100 as a hardening liquid or semi-liquid.

Some embodiments include a lid 600 sized to cover the top of the inner shell 300. One embodiment of the lid 600 is shown in FIG. 6. The lid 060 serves primarily to block radiant energy from sunlight and to reduce heat transfer through convection. The lid 600 can be made of any suitable material, including material not ordinarily used for thermal insulation. In some embodiments, the lid 600 comprises additional accessories for the device, including any one or more of a measuring cup for the solute (e.g., salt mixture) necessary for a slurry or brine, a bottle opener, a hatch for insertion and extraction of material from inside the basin, a solid surface to deliver an impact on the bottle as it is being removed.

In some embodiments, in the assembled state, the upper body rests on the power section. The power section of the cooler in a particular embodiment comprises a motor housing stand, a rotating head 200, a motor, a rotating mount and an electrical line or battery. In some embodiments, the motor is secured within the housing and rotationally secured to the rotating head 200. The rotating head 200 serves as the contact point between the power section and the body of the cooler and to transfer rotational energy from the motor to the cooler. In some embodiments, the power section imparts linear motion instead of rotational motion. Other movements can similarly be incorporated into the teachings of the present disclosure.

In the preferred embodiment, the rotating head 200 is a thin circular member that is operationally affixed (e.g., secured through bolts and/or other connecting parts) to the motor linkage and provides a plate-like base on which the upper body can sit when the device is in its fully assembled state. An embodiment of this rotating head 200 is shown in FIG. 2. The rotating head 200 also comprises in this embodiment a matching set of tabs 201 to the slots 101 on the outer liner of the upper body. The tabs 201 are beneficially arranged to slide within the slots 101 and impart the rotational energy on the upper body. In one embodiment, there are four tabs 201, each 0.750 inches tall. This corresponds to the 0.875 inch depth of the slots in the base of the outer shell of the upper body, plus 0.125 of space for ease of use, ease of manufacture without tight tolerances, and quick assembly and disassembly. As with the slots, the four tabs 201 are arranged in an arc manner, each spanning approximately 450 of a complete circle with approximately 450 spacing between each. In this manner, they are positioned to fit within the slots of the upper body outer shell and immediately place that section into a correct alignment for operation. The rotating head 200 is primarily a short cylinder or tapered cylinder and its outer surface is a slightly tapered cylindrical surface (or a frustoconical surface) with the upward jutting tabs 201. The inside surface of the rotating head 200 is an oppositely disposed tapered cylinder or frustoconical surface, designed to engage with the motor housing on which it rests. It is sized and shaped such that the rotating head 200 can be quickly and easily placed onto the base and because of each piece's corresponding partial conical section, the two will easily align for final assembly. In the described embodiment, the underside of the rotating head 200 can have protrusions or bosses disposed vertically downward arranged to guide the arms of the rotating mount to through holes in the rotating head 200. In some embodiments, the protrusions can be fashioned and positioned with tight enough tolerances around the rotating mounts such that when these rotating mounts are secured to the rotating head 200 and reciprocating through motion of the motor, the protrusions transfer some or all of the rotational energy from the rotating mounts to the rotating head 200 without excessive stress on the fastener connecting the rotating head 200 to the rotating mount. In one embodiment, the protrusions or bosses are disposed substantially perpendicular to the rotating mounts in their affixed state such that rotational forces are directed along the longest axis of the protrusions. In the preferred embodiment, there are sixteen such protrusions, arranged with four on each of the four rotating mounts.

In one embodiment, the largest diameter of the rotating head 200 is its upper portion and is 18.265 inches and the narrow diameter on the opposite lower side after the taper is 17.915 inches. The total thickness of the rotating head 200 in this embodiment is 2.063 inches, which comprises the 0.750 inch tabs 201 and 1.313 inch height for the main body of the rotating head 200.

In the assembled state the motor housing stand is below the rotating head 200.

In the preferred embodiment, the motor is fixedly attached to the rotating head 200 or interface plate 200 such that the head or plate can be alternatively rotated clockwise and counter clockwise in a repeating pattern about the center-point of the rotating head 200. In that embodiment, the rotation is horizontal; that is, in its assembled state and operable, under the teachings of this disclosure, the largest surface of the rotating head 200 is substantially parallel to the ground and when powered rotates in that same plane. In one embodiment, the motor 409 is connected to a rotating mount 411, which in turn connects to the rotating head 200. In this embodiment, the linkage arm 413 from the motor connects to the rotating mount by a fastener in such a position that a revolution of the motor and the consequent movement of the linkage arm of does not cause full circular motion of the rotating mount 411. In this manner, the linkage arm extends from the motor, located approximately centered within the motor housing 400, to a point near the outer edge of the rotating head. The center-points of the motion of each side of the linkage arm (the motor side and the rotating head side) can be vertically aligned or non vertically aligned, with the rotating head side having a larger radius than the motor side. Because of the geometries of this embodiment, as the motor turns, the linkage arm is in alternating tension and compression, as it pulls and pushes the rotating head in a reciprocating arc motion, necessarily less than 180°. This can be implemented with different linkages between the motor and the rotating head 200, including double rocker mechanisms, crank-rocker mechanisms, and triple rocker mechanisms. In the preferred embodiment, the linkage arm connects to the rotating mount at the same vertical position as the pass-through hole in the rotating head 200, such that a single fastener of sufficient length (e.g., a bolt) can connect each of the three pieces. The speed of rotation and possible angle of rotation of rotating head 200 is determined by the speed of the motor, the length of the linkage arm, and the location of the connection between the linkage arm and the rotating mount. This specification contemplates variations in each to change the speed and angle of rotation. In the preferred embodiments, the range of motion of the rotating head 200 is substantially smaller than a full revolution. In a particular embodiments, the range of motion of the rotating head 200 is between 30 and 60 degrees. In certain embodiments, considerations of the amount of j ostling of the beverage containers, stress on the motor and connecting parts, and power requirements are evaluated for proper speed of rotation. With respect to each consideration, the lower amount of each is preferred. In many embodiments, the reciprocation of the rotating head 200 ranges between 0.5-2.0 Hz. This range has been determined through testing to be an adequate range to prevent premature crystallization and limit the agitation of typically carbonated beverages, wherein carbonation can cause the beverage to overly bubble upon opening. The purpose of the rotation of the head is to impart rotational energy on the body of the cooler to cause constant agitation of the cooling material (e.g., ice and water) therein to facilitate even distribution of the fluid within the basin and to keep the beverages circulating to oppose crystallization. With the reciprocatory motion imparted by the engine, the cooling fluid within the body is alternatively forced in different directions and avoids settling in any position and freezing. Because of, for instance, the frictional forces between the various surfaces (e.g., the walls and the floor of the basin, the sizes of the beverage containers) and the cooling fluid, the fluid is first forced in once direction and begins a circular path in that direction. Soon, however, the alternatively rotating motion of the basis switches direction, and the cooling fluid is then forces in the opposite direction. In this manner, the inertia of the cooling fluid results results in a lag between the motion of the beverage containers and the cooling fluid. There is constant relative motion between the fluid itself and the beverage containers.

In some embodiments, the rotating head 200 and motor are attached by fasteners, e.g., bolts passing through the rotating head 200, through other combinations of pieces, including mounts, direct linkage arms, gears or otherwise. The rotating head 200 has appropriately sized pass-through holes sized and shaped to meet the motor linkage 411 beneath. In the preferred embodiment each of the pass-through holes are 0.469 inches in diameter and placed approximately on the midpoint of the sides of a square centered on a center-point of the rotating head 200, with approximately 7.436 sides; that is, each hole is approximately 3.718 inches from the midpoint. It should be understood that this feature is designed for the purpose of meeting up with the motor linkage below; if the motor linkage varied in size, position, or shape, the corresponding holes would need to moved accordingly.

The motor is housed in some embodiments in the motor housing stand 400. One embodiment of the motor housing stand is shown in FIG. 4. In some embodiments, the majority of the motor housing stand 400 has a generally cylindrical or frustoconical outer surface, continuing along substantially the same rate of taper as the upper body and the rotating head 200. Disposed above this primary large frustoconical surface 401 of this piece in this embodiment is an oppositely disposed frustoconical surface 402, sized and positioned to mate with the rotating head 200 to be positioned on top of it and to allow rotation of the rotating head 200. In a preferred embodiment and when molds are the expected manufacturing process, frustoconical surfaces are preferred over cylindrical surfaces because of their ease of removal from molds. The bottom of the motor housing stand 400 can be arranged with pass-throughs 405 for bolts to attach a rotating mount base 407 to the motor housing stand. In a preferred embodiment, similar upward protrusions or bosses 403 extend from the bottom of the motor housing stand as with the rotating head 200 and for the same purpose: to align the rotating mount base with the pass through holes and to transfer any rotational energy from the motor 409 to the motor housing stand without relying on the bolts and pass through holes alone. In the case of these protrusions or bosses 403, when the device is fully assembled and operating, the protrusions or bosses 403 provide forces opposing motion and transfer the stability of the ground on which the motor housing stand rests to the rotating mount base. In many embodiments, additional features are added to the underside of the motor housing stand to have the device rest on an appropriate surface, e.g., the ground. In some embodiments, the underside is fitted with rubber stands that extend beyond the base to better grip the surface and to reduce scarring.

In a preferred embodiment, the motor housing stand is shaped to allow for lifting. Because the preferred embodiment does not use fasteners between the upper and lower sections, when an embodiment is created according to this method and it is in its upright state, lifting from anything above the base would cause the embodiment to disassemble. An advantage of this is the easy of assembly and disassembly, where the device can be put together and taken apart not only with without any tools be with only a vertical lift of the upper section. As such, it is advantageous to have oppositely disposed depressions on the cylindrical face of the base, with a flat surface (i.e., parallel to the ground) on the top to serve as a finger grip for lifting. In a particular embodiment, the base is 17.848 inches in diameter at its widest with a taper to 16.249 inches to its most narrow. It can be made in this embodiment of material 0.313 inches thick. The portion of the base that mates with the rotating head 200 is 0.700 inches tall, and the portion below is 6.345 inches, for a combined height of 7.045 inches in this embodiment. Each of the pass through holes for mounting rubber stands can be 0.344 inches in diameter.

A beverage separator 500 can be placed in some embodiments inside the upper cooler body. One embodiment of the beverage separator device 500 is shown in FIG. 5. The beverage separator 500 should be advantageously shaped to keep multiple beverage containers (e.g., bottles) separated from each other to minimize the chance of impact while the cooler body is rotated or agitated. The separator 500 should also be designed to allow sufficient space between the containers for the cooling fluid to flow between the containers in sufficient volume to allow for supercooling of the beverages. In one embodiment, a beverage separator 500 contains eighteen circular spaces 503 sized for insertion of bottles. In this embodiment, the circular spaces 503 are efficiently arranged in three concentric circles to most effectively fit within the cooler body. The concentric circles have one, six, and eleven spaces 503 respectively. Each of the spaces 503 for placing a beverage container has eight downward and inward facing fingers 502 ringing the space 503 and angled inwardly to apply symmetric or approximately symmetric gripping force on each side of the beverage container. In many embodiments, these fingers 502 are sized, angled, and made of appropriate material to allow the space 503 to hold a variety of sizes of beverage containers. In many embodiments, the beverage separator 500 and the fingers 502 are made of a single construction and are of a pliable plastic material. In these embodiments, different bottle sizes can be accommodated by having the downward facing fingers 502 flex to different diameters. In these embodiments, the fingers 502 are sized and placed such that when a larger diameter bottle is placed within their periphery, they each flex away from the bottle, with the spring force caused by the flexion holding the bottle in place. In some embodiments, the circular spaces are sized to hold different common beer bottle sizes, e.g., bombers, long necks, heritage, stubby, and pony bottles. For most applications, the circular spaces could be sized to hold bottles expected to range from 2.408 to 2.578 inches diameter (long neck and heritage bottles, respectively). To do this, each circular space in most of the various embodiments would be sized at or above the largest diameter to be used. In the embodiments mentioned, they would be sized at something larger than 2.578 inches diameter. The downward facing fingers 502 should be arranged such that when the fingers 502 are in their relaxed, unflexed state, their innermost points form a circle with a diameter at or smaller than the smallest diameter bottle expected to be used, in this embodiment 2.408 inches diameter. As the diameter of ring created by the ends of the fingers 502 becomes smaller in some embodiments, the greater the force should be expected to be exerted on the bottle in those embodiments. By example, a circular space of 3.00 inches with inwardly pointing fingers 502 forming a 2.30 inch circle would be able to hold both long neck and heritage bottles. There are many sizes of spaces appropriate for the various embodiments sized for each of the known beverage container types, for other types of beverage containers (e.g., wine bottles), for other types of containers to be cooled, for sizes and shapes of containers that are not traditional, currently popular, currently available, or currently existing, or for variable holding devices that can be sized and adjusted for applicability to different containers.

In some embodiments, the beverage separator 500 contains keys 501 that align with slots 303 in the cooler body, such as the inner surface of the inner lining, to allow consistent placement of the beverage separator 500 in the cooler body. In an embodiment, the keys 501 are eight tabs that extend radially from the beverage separator 500 a short distance of approximately one half inch. These keys 501 align with slots 303 in the cooler body that allow for placement of the beverage separator 500 within the cooler body such that the circular spaces align over the beverage depressions 302 within the cooler body. In a preferred embodiment, the slots 303 are formed in the inner lining 300 of the cooler body. In some embodiments, the keys 501 and slots 303 are not symmetrically arranged around the circumference of the beverage separator 500 and the inner shell lining such that the beverage separator 500 can only be placed in the inner shell one way. In other embodiments one or more of the tabs and slots 303 are uniquely shaped or positioned to allow for only one correct way to insert the beverage separator 500 into the cooler body. The reader will appreciate there are a number of ways to accomplish substantially the same goal of providing the user an indication of the proper alignment of the beverage separator 500, including markings, non-circular shapes, coloring, limiting removability and so on. Each version is contemplated within this disclosure.

In many embodiments, each of the separator and the upper basin, particularly the inner liner, is made of a material that does not generate high shocks when impacting the beverage containers, e.g., molded plastics. The system is able to maintain sub-freezing temperatures within the beverages because of the elimination or substantial elimination of nucleation points within the beverage containers. Shock waves can provide nucleation points. In this manner, the occasional impact between the beverage container and the surrounding materials can undo the efforts of lowering the beverage temperature to sub-freezing without crystallizing.

In some embodiments, supercooled temperatures are reached in the beverages. Under the techniques taught by this disclosure, the beverages can be lowered below their typically understood freezing point without solidifying or crystallizing. Freezing points are understood in lay terms to be the point at which crystallization of the fluid occurs in the presence of a nucleation point, but are more accurately understood to be the opposite: the point at which solid water transforms into liquid water. It takes more energy transfer for water to transform from liquid to solid because of the energy necessary to manipulate the water molecules into a crystalline structure. In many beverages or in distilled water, there are no impurities to serve as points of nucleation or if such impurities exist they are wholly dissolved in the beverage. In this state with no points of nucleation in an ideal scenario, the freezing point is a point much lower than the traditionally understood freezing point; instead, it freezes at the point of crystal homogenous nucleation. In many embodiments, the crystallization will begin when the beverage container is tapped or otherwise impacted on the side. This tapping tends to cause a shock wave or force the formation of bubbles from the trapped gasses within the beverage and provide one or more nucleation points for the ice crystals to begin to form. Salt water or other fluid with a freezing temperature below the freezing temperature of water (or other beverage to be cooled) can be used as a fluid to circulate between the bottles. A fully saturated salt water solution has a freezing temperature of around minus 21° C. or minus 6° F. A fluid such as fully or semi-saturated salt water solution can be maintained in a liquid state and circulated using the reciprocal or linear motion of the motor imparted onto the upper portion of the cooler under the teachings of this disclosure. The beverages likewise are constantly moving because of the same reciprocal or linear motion; as the motor rotates the rotating head 200 in those embodiments, circular motion is imparted onto the upper container and on the bottles held therein. This constant-motion, supercooled, low-impact state that the bottles are in is ripe for supercooling beverages without crystallizing. Once a beverage is removed from the cooling environment in the device under this disclosure and while it remains in its supercooled state, it is possible to induce crystallization in a number of ways. In some embodiments, a shock wave is presented through a light impact on the bottle. In certain embodiments of the present disclosure, a physical shock section is included. This physical shock section can include points designed for impact of a beverage container. The physical shock section can be incorporated into the lid 600 or side of the device, including the exterior of the basin. The shock section can be one or more metal points or points made of other materials designed to give sharp reaction when impacted with the beverage containers. In some embodiments, the points are arranged in a ring larger than the typical diameter of a beverage container such that a container can be placed in the middle of the ring and tapped in a circle to begin the crystallization process. In these embodiments, the shock section and resulting crystallization is intended to be used immediately before drinking the beverage. In some embodiments, a nucleus point can be added to the beverage, or the beverage could be poured into a second container, which would provide a nucleation point and result in the poured liquid becoming slush-like.

As shown in FIG. 6, a lid 600 can be made to fit in or on the upper basin, or within the inner liner 300 or the outer shell 100. The lid 600 serves typically to prevent solar radiation from reaching the beverages that are being chilled and to limit airflow between the chilled air within the upper basin and the outside environment.

Some aspects of the present disclosure include a system for cooling beverages, comprising: an upper insulated basin having a floor and a side surface, the upper insulated basin further comprising an interior volume sized to allow placement of cooling fluid and a plurality of beverage containers; a separator device sized to restrain the plurality of beverage containers such that during agitation, each of the plurality of beverage containers does not impact any other of the plurality of beverage containers or the side surface of the upper insulated basin and allows for cooling fluid to contact an exterior surface of each of the plurality of beverage containers; and an agitation section placeable in physical communication with the upper basin that can provide, when activated, motion to the upper insulated basin.

Some aspects of the present disclosure include the above system, wherein the agitation section comprises an electric motor in rotatable communication with the upper insulated basin, said rotatable communication including counterclockwise and clockwise motion.

Some aspects of the present disclosure include the above system, wherein the floor of the upper insulated basin further comprises a plurality of recesses sized to fit a lower portion of each of the plurality of beverage containers; and wherein the separator device further comprises a plurality of individual sections for each of the plurality of beverage containers and is securable such that the plurality of recesses is vertically aligned with the plurality of individual sections.

Some aspects of the present disclosure include the above system, wherein the agitation section and the upper basin are connected by a removable connection.

Some aspects of the present disclosure include the above system, wherein the system has an upright orientation such that the upper insulated basin is vertically above the agitation section; and the removeable connection comprises: one or more extrusions; and one or more recesses sized and positioned to mate with each of the one or more extrusions, such that, when the system is in the upright orientation, the recesses and extrusions limit relative horizontal motion between the agitation section and the upper basin and do not limit the upper basin from being vertically removed from the agitation section.

Some aspects of the present disclosure include the above system wherein the agitation section comprises an electric motor in rotatable communication with the upper insulated basin, said rotatable communication including counterclockwise and clockwise motion.

Some aspects of the present disclosure include the above system wherein the separator device comprises eighteen sections and the upper basin comprises eighteen sections sized to fit beverage containers.

Some aspects of the present disclosure include the above system further comprising a physical shock section.

Some aspects of the present disclosure include a portable beverage cooler device, comprising: an basin comprising waterproof walls and fillable with at least five vertical inches of cooling fluid; a power section in moveable communication with the basin that, when activated, provides movement to the basin.

Some aspects of the present disclosure include the above device wherein the movement provided by the power section to the basin is alternating clockwise and counterclockwise rotation.

Some aspects of the present disclosure include the above device wherein the power section comprises an electric motor, the electric motor is connected by an arm to a rotating head by a place connection, the place connection and arm sized and positioned such that circular motion in a single direction by the electric motor results in alternating circular clockwise and counterclockwise motion by the rotating interface.

Some aspects of the present disclosure include the above device wherein the alternating clockwise and counterclockwise rotation is between 0.5 Hz and 2.0 Hz.

Some aspects of the present disclosure include the above device wherein the alternating clockwise and counterclockwise rotation is between 30 degrees and 60 degrees.

Some aspects of the present disclosure include a method of cooling beverages, comprising the steps of: filling, at least in part, a basin with cooling fluid below 32° F.; placing a first beverage container within the basin such that a surface of the first beverage container is in contact with the cooling fluid; and agitating the basin with an agitation section; wherein the agitation section comprises an electric motor in rotatable communication with the basin, said rotatable communication including counterclockwise and clockwise motion.

Some aspects of the present disclosure include the above method further comprising the steps of: restraining a plurality of beverage containers within the basin adjacent to the first beverage containers such that none of the plurality of beverage containers nor the first beverage containers are in contact with any of the other beverage containers.

Some aspects of the present disclosure include the above method wherein the plurality of beverage containers are restrained by a separator comprising circles sized and spaced to allow the cooling fluid to contact each of the plurality of beverage containers.

Some aspects of the present disclosure include the above method where the agitation section comprises and electric motor linked to a rotating head; and the counterclockwise and clockwise motion being between 0.5 Hz and 2.0 Hz.

Some aspects of the present disclosure include the above method further comprising the steps of: lowering the temperature of a beverage within the first beverage container to a temperature less than 32° F.; and maintaining the beverage in a fluid state.

Some aspects of the present disclosure include the above method further comprising the step of: circulating the cooling fluid within the basin.

Some aspects of the present disclosure include the above method wherein the clockwise and counterclockwise motion is between 30° and 60°.

The reader should appreciate that the present application describes several inventions. Rather than separating those inventions into multiple isolated patent applications, applicants have grouped these inventions into a single document because their related subject matter lends itself to economies in the application process. But the distinct advantages and aspects of such inventions should not be conflated. In some cases, embodiments address all of the deficiencies noted herein, but it should be understood that the inventions are independently useful, and some embodiments address only a subset of such problems or offer other, unmentioned benefits that will be apparent to those of skill in the art reviewing the present disclosure. Due to costs constraints, some inventions disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such inventions or all aspects of such inventions.

It should be understood that the description and the drawings are not intended to limit the invention to the particular form disclosed, but to the contrary, the intention is to cover all modifications, equivalents, and alternatives falling within the spirit and scope of the present invention as defined by the appended claims. Further modifications and alternative embodiments of various aspects of the invention will be apparent to those skilled in the art in view of this description. Accordingly, this description and the drawings are to be construed as illustrative only and are for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," "centerpoint" and the like or mathematical constructs like numerical designations of uncountable nouns such as "half of a liter of water" or "two inches", should be construed as encompassing items that substantially embody the properties of the geometric construct, e.g., reference to "parallel" surfaces encompasses substantially parallel surfaces and reference to "half" a measurement of a fluid encompasses substantially half. The permitted range of deviation from Platonic ideals of these geometric and mathematic constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct.

We claim:

1. A system for cooling beverages, comprising:

an upper insulated basin having a floor and a side surface, the upper insulated basin further comprising an interior volume sized to allow placement of cooling fluid and a plurality of beverage containers;

a separator device sized to restrain the plurality of beverage containers such that during agitation, each of the plurality of beverage containers does not impact any other of the plurality of beverage containers or the side surface of the upper insulated basin and allows for cooling fluid to contact an exterior surface of each of the plurality of beverage containers, wherein the separator device defines a plurality of spaces where each space of the plurality of spaces is configured to receive a beverage container of the plurality of beverage containers and the separator device includes, for each space that a portion of the separator device defines, a plurality of downward and inward facing fingers that are configured to grip a beverage container at a diameter that is less than a diameter of the portion of the separator device that defines the space to allow the cooling fluid to flow between the portion of the separator device and that beverage container gripped therein; and an agitation section placeable in physical communication with the upper insulated basin, the agitation section imparting, when activated, an alternating force into the upper insulated basin to cause the upper insulated basin to alternately rotate with counterclockwise and clockwise motion in relation to the agitation section, wherein the upper insulated basin is configured such that the alternative rotation of the upper insulated basin is transferred to both the cooling fluid and the plurality of beverage containers in a manner to prevent crystallization of fluid in the plurality of beverage containers and the cooling fluid during supercooling of that fluid with the cooling fluid.

2. The system of claim 1, wherein the agitation section comprises an electric motor in rotatable communication with the upper insulated basin, said rotatable communication including counterclockwise and clockwise motion.

3. The system of claim 1, wherein the floor of the upper insulated basin further comprises a plurality of recesses sized to fit a lower portion of each of the plurality of beverage containers such that the plurality of recesses is vertically aligned with the plurality of spaces.

4. The system of claim 3, wherein the agitation section and the upper insulated basin are in physical communication by a removable connection that imparts the alternating force without restricting separation of the upper insulated basin from the agitation section in a different direction.

5. The system of claim 4, wherein the system has an upright orientation such that the upper insulated basin is vertically above the agitation section without any fasteners between the upper insulated basin and the agitation section that would otherwise limit the upper insulated basin from being vertically removed from the agitation section; and the removable connection comprises:

one or more extrusions; and one or more recesses sized and positioned to mate with each of the one or more extrusions, such that, when the system is in the upright orientation, the one or more recesses and extrusions limit relative horizontal motion between the agitation section and the upper insulated basin to impart the alternating force and do not limit the upper insulated basin from being vertically removed from the agitation section.

6. The system of claim 1, further comprising a physical shock section that includes one or more points included on an exterior surface of the upper insulated basin or included on a lid that is configured to cover the upper insulated basin.

7. The system of claim 1, wherein the plurality of beverage containers are beer bottles that house beer.

8. The system of claim 1, wherein the separator device includes a plurality of separator keys that are each configured to be inserted into a respective lining layer slot included on the side surface of the upper insulated basin.

9. The system of claim 8, wherein the respective lining layer slots are positioned above the floor of the upper insulated basin such that when each of the plurality of separator keys of the separator device are inserted into the respective lining layer slot, the plurality of downward and inward facing fingers are aligned to contact a beverage container nearer to a vertical midpoint of a beverage container than a bottom of that beverage container.

10. The system of claim 1, wherein the plurality of downward and inward facing fingers are flexible in an outward direction away from a beverage container to apply a spring force on the beverage container.

11. A portable beverage cooler device, comprising:

a basin comprising waterproof walling extending from a waterproof floor, the waterproof walling and the waterproof floor defining an interior volume fillable with at least five vertical inches of cooling fluid, wherein:

an interior surface of the walling and the floor defines at least the interior volume fillable with the at least five vertical inches of cooling fluid and is devoid of any holes therethrough, and an exterior surface of the basin comprises a first interface;

a power section comprising a second interface in physical communication with the first interface to transfer force into the first interface in a plane without restricting separation of the basin from the power section in a direction normal to a horizonal plane, the power section, when activated, providing movement to the basin, wherein the basin is configured such that the movement of the basin provides movement to the cooling fluid and one or more beverage containers when the at least five vertical inches of cooling fluid and the one or more beverage containers are present to prevent crystallization of fluid in the one or more beverage containers during supercooling of that fluid with the cooling fluid; and a separator device sized to restrain the one or more beverage containers such that during the movement of the basin, each of the one or more of beverage containers does not impact any other of the one or more beverage containers or the waterproof walling of the basin and allows for the cooling fluid to contact an exterior surface of each of the one or more beverage containers, wherein the separator device defines a plurality of spaces where each space of the plurality of spaces is configured to receive a beverage container of the one or more beverage containers and the separator device includes, for each space that a portion of the separator device defines, a plurality of downward and inward facing fingers that are configured to grip a beverage container at a diameter that is less than a diameter of the portion of the separator device that defines the space to allow the at least five vertical inches of cooling fluid to flow between the portion of the separator device and that beverage container gripped therein.

12. The device of claim wherein providing movement to the basin comprises:

imparting, when activated, an alternating force into the first interface via the second interface to cause the basin to alternately rotate with counterclockwise and clockwise motion in relation to the power section.

13. The device of claim 12, wherein the power section comprises an electric motor, the electric motor is connected by an arm to the second interface by a fixed place connection, the fixed place connection made at a position on the second interface and the arm sized such that circular motion in a single direction by the electric motor results in alternating circular clockwise and counterclockwise motion by the second interface.

14. The device of claim 13, wherein the alternating clockwise and counterclockwise rotation is between 0.5 Hz and 2.0 Hz.

15. The device of claim 13, wherein the alternating clockwise and counterclockwise rotation is between 30 degrees and 60 degrees.

16. A method of cooling beverages, comprising the steps of:

filling, at least in part, a basin with cooling fluid below 32° F.;

placing a first beverage container within the basin such that a surface of the first beverage container is in contact with the cooling fluid, wherein the first beverage container is placed in a separator device sized to restrain a plurality of beverage containers such that during agitation, the first beverage container does not impact any other beverage containers or a side surface of the basin and allows for cooling fluid to contact an exterior surface of the first beverage container, wherein the separator device defines a plurality of spaces where each space of the plurality of spaces is configured to receive a beverage container and the separator device includes, for each space that a portion of the separator device defines, a plurality of downward and inward facing fingers that are configured to grip a beverage container at a diameter that is less than a diameter of the portion of the separator device that defines the space to allow cooling fluid to flow between the portion of the separator device and that beverage container gripped therein, and wherein the first beverage container, when placed in the separator device, is gripped by a first plurality of downward and inward facing fingers in a first space of the plurality of spaces; and agitating the basin with an agitation section;

wherein the agitation section comprises an electric motor in rotatable communication with an exterior interface of the basin, said rotatable communication imparting an alternating force into the exterior interface to cause the basin to alternately rotate with counterclockwise and clockwise motion, wherein the basin is configured such that the alternative rotation of the basin is transferred to both the cooling fluid and the first beverage container to prevent crystallization of fluid in the first beverage container during supercooling of that fluid with the cooling fluid.

17. The method of claim 16, wherein the agitation section comprises an electric motor linked to a rotating head; and the counterclockwise and clockwise motion being between 0.5 Hz and 2.0 Hz.

18. The method of claim 16, further comprising the steps of:

lowering a temperature of the fluid within the first beverage container to a temperature less than 32° F.; and maintaining the beverage in a fluid state.

19. The method of claim 18, further comprising the step of:

circulating the cooling fluid within the basin.

20. The method of claim 17, wherein the clockwise and counterclockwise motion is between 30° and 60°.

* * * * *